US007073827B2

(12) United States Patent
Cherry

(10) Patent No.: US 7,073,827 B2
(45) Date of Patent: Jul. 11, 2006

(54) ELECTROMECHANICAL LATCHING SYSTEM

(75) Inventor: Hitesh Cherry, Harrisburg, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/414,341

(22) Filed: Apr. 14, 2003

(65) Prior Publication Data

US 2004/0000205 A1 Jan. 1, 2004

Related U.S. Application Data

(60) Provisional application No. 60/372,481, filed on Apr. 14, 2000, provisional application No. 60/405,260, filed on Aug. 21, 2002, provisional application No. 60/460,368, filed on Apr. 4, 2003.

(51) Int. Cl.
*E05C 3/06* (2006.01)

(52) U.S. Cl. ..... 292/201; 292/144

(58) Field of Classification Search ..... 292/144, 292/201, 341.16; 49/280, 89, 89.39, 83.37; 74/31, 424.8
See application file for complete search history.

(56) References Cited

U.S. PATENT DOCUMENTS

| | | | | |
|---|---|---|---|---|
| 1,592,696 | A | 7/1926 | Heyer | |
| 2,860,904 | A | 11/1958 | Barry et al. | |
| 3,277,736 | A * | 10/1966 | Goodman | 74/89.37 |
| 3,302,964 | A | 2/1967 | Barry | |
| 3,402,958 | A | 9/1968 | Barry | |
| 4,472,846 | A * | 9/1984 | Volk et al. | 5/611 |
| 4,552,001 | A | 11/1985 | Roop | |
| 4,583,775 | A | 4/1986 | Bisbing | |
| 4,672,858 | A * | 6/1987 | Langowski | 74/89.38 |
| 4,796,930 | A | 1/1989 | Baynes | |
| 4,899,561 | A | 2/1990 | Myers | |
| 4,927,286 | A | 5/1990 | Hobluigie et al. | |
| 5,022,243 | A | 6/1991 | Embry et al. | |
| 5,037,145 | A * | 8/1991 | Wilkes | 292/201 |
| 5,134,731 | A * | 8/1992 | Quintile et al. | 5/11 |
| 5,269,161 | A | 12/1993 | Stillwagon | |
| 5,467,619 | A | 11/1995 | Stillwagon | |
| 5,813,257 | A | 9/1998 | Claghorn et al. | |
| 5,997,054 | A * | 12/1999 | Baudu et al. | 292/201 |
| 6,068,305 | A | 5/2000 | Myers et al. | |
| 6,496,101 | B1 | 12/2002 | Stillwagon | |
| 6,575,504 | B1 | 6/2003 | Roatis et al. | |
| 6,641,182 | B1 | 11/2003 | Schlack et al. | |
| 2002/0083747 | A1 | 7/2002 | Beylotte et al. | |

OTHER PUBLICATIONS

Southco 2000 Handbook, Front and Back covers, pp. 24-38 and 54-64, 1999.
Southco 2002 Handbook, Front and Back covers, pp. 143-145, 2001.

* cited by examiner

*Primary Examiner*—Gary Estremsky
(74) *Attorney, Agent, or Firm*—Paul & Paul

(57) ABSTRACT

An electromechanical latching system for locking a cabinet door and the like is disclosed. The latching system includes a motor drive that may include a gearbox. The motor drive selectively rotates a screw. In one embodiment, the screw engages a threaded opening of a pawl and the screw is used to pull up the pawl against, for example, a doorframe to secure, for example, a door against the doorframe. In another embodiment, the screw engages a threaded opening of an actuating arm such that rotation of the screw linearly moves the actuating arm along the length of the screw. The actuating arm engages an operating rod that operates one or more pawl assemblies to engage or disengage respective keepers.

16 Claims, 36 Drawing Sheets

ELECTROMECHANICAL LATCHING SYSTEM

CROSSREFERRENCE TO RELATED APPLICATIONS

This application claims the benefit of the priority of U.S. Provisional Patent Application Ser. No. 60/372,481 filed on Apr. 14, 2002, U.S. Provisional Patent Application Ser. No. 60/405,260, filed on Aug. 21, 2002, and U.S. Provisional Patent Application Ser. No. 60/460,368 filed on Apr. 4, 2003.

BACKGROUND OF THE INVENTION

1. Field of the Invention

The present invention relates to an electromechanical latching system for releasably securing a first member, such as a door or the like, relative to a second member.

2. Description of the Prior Art

Latching systems are used to releasably secure panels, covers, doors, electronic modules, and the like to other structures such as compartments, cabinets, containers, doorframes, other panels, frames, racks, etc. Although latching systems are known in the art, none offers the advantages of the present invention. The advantages of the present invention will be apparent from the attached description and drawings.

SUMMARY OF THE INVENTION

The present invention is directed to an electromechanical latching system for locking a cabinet door and the like. The latching system includes a motor drive that may include a gearbox. The motor drive selectively rotates a screw. In one embodiment, the screw engages a threaded opening of a pawl and the screw is used to pull up the pawl against, for example, a doorframe to secure, for example, a door against the doorframe. In another embodiment, the screw engages a threaded opening of an actuating arm such that rotation of the screw linearly moves the actuating arm along the length of the screw. The actuating arm engages an operating rod that operates one or more pawl assemblies to engage or disengage respective keepers.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
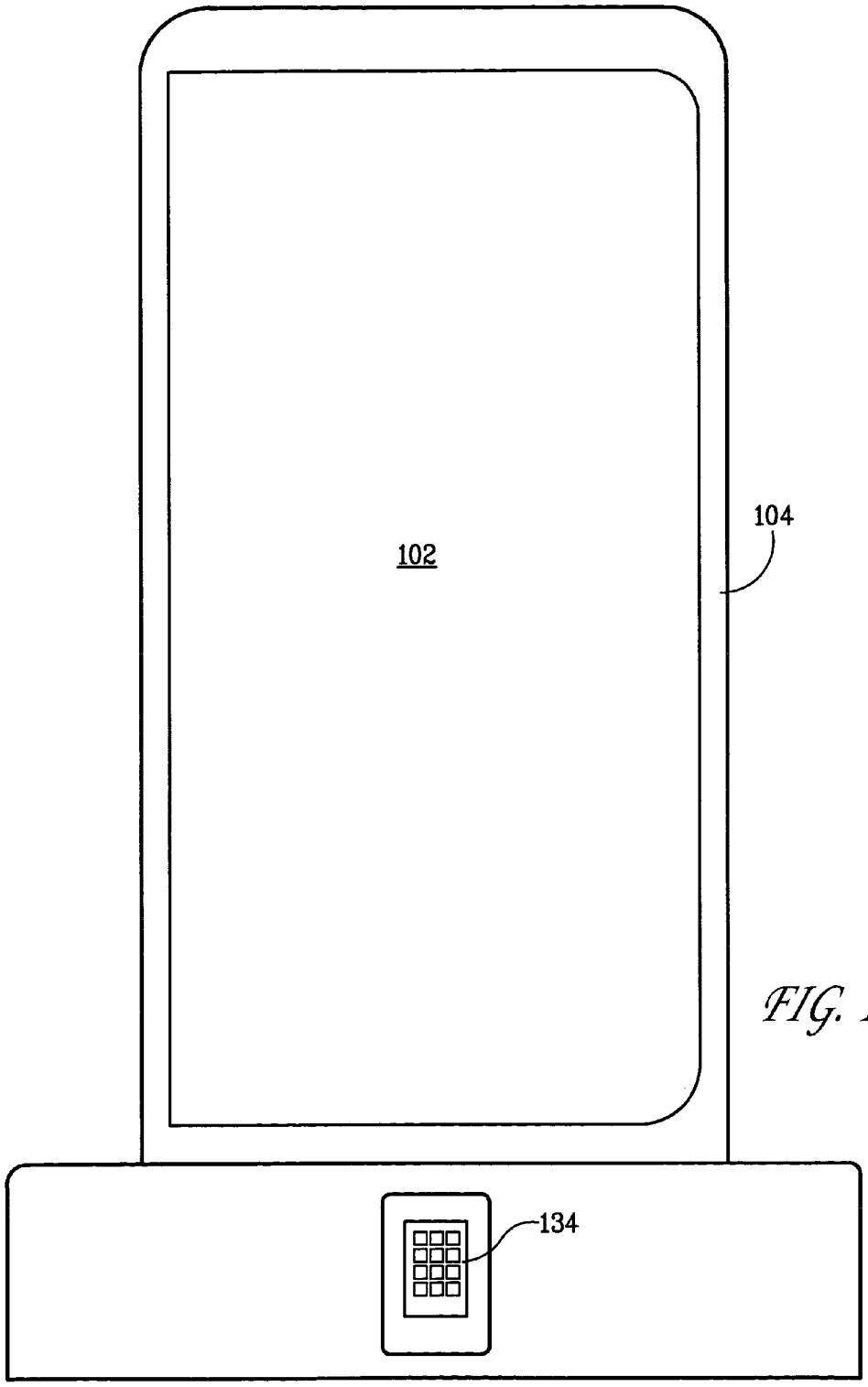
FIG. 1 is an environmental view showing a mock-up door and doorframe for illustrating the use of the electromechanical latching system of the present invention.
Figure 2:
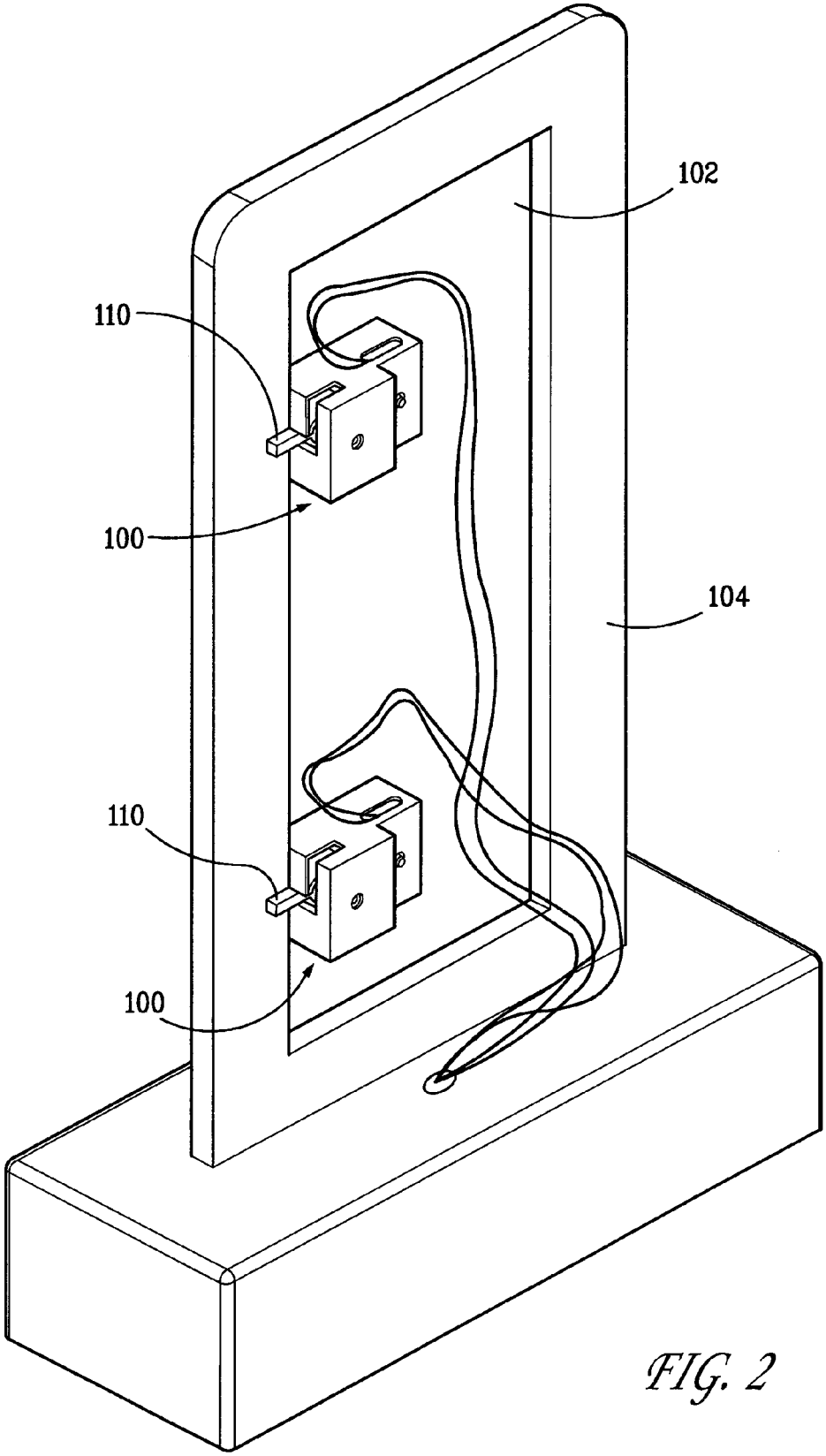
FIG. 2 is an environmental view showing a mock-up door and doorframe with the electromechanical latching system of the present invention installed on the door with the electromechanical latching system securing the door in the closed position.
Figure 3:
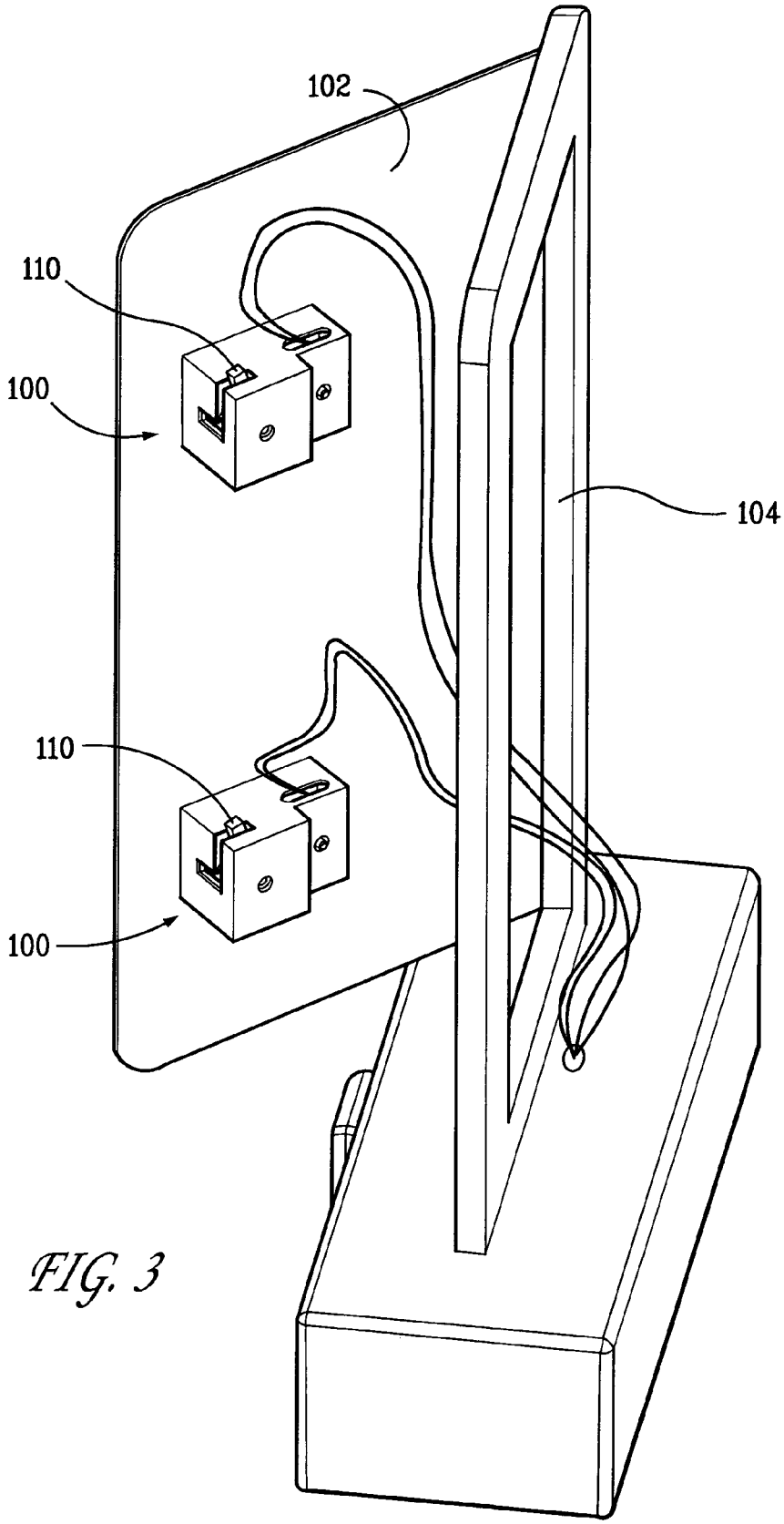
FIG. 3 is an environmental view showing a mock-up door and doorframe with the electromechanical latching system of the present invention installed on the door with the door in the open position.
Figure 4:
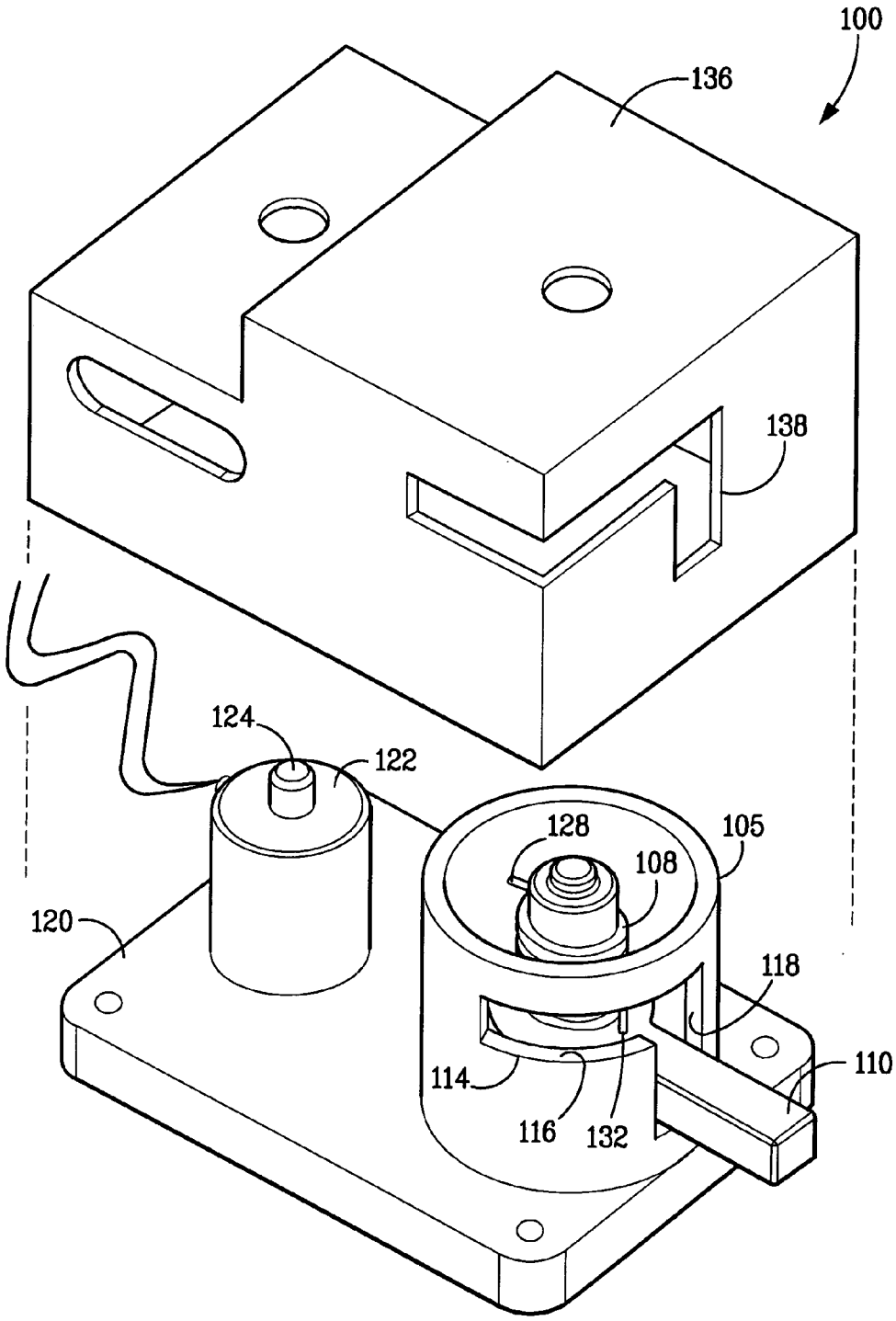
FIG. 4 is an exploded view showing a door-mountable electromechanical latch of the electromechanical latching system of the present invention.
Figure 5:
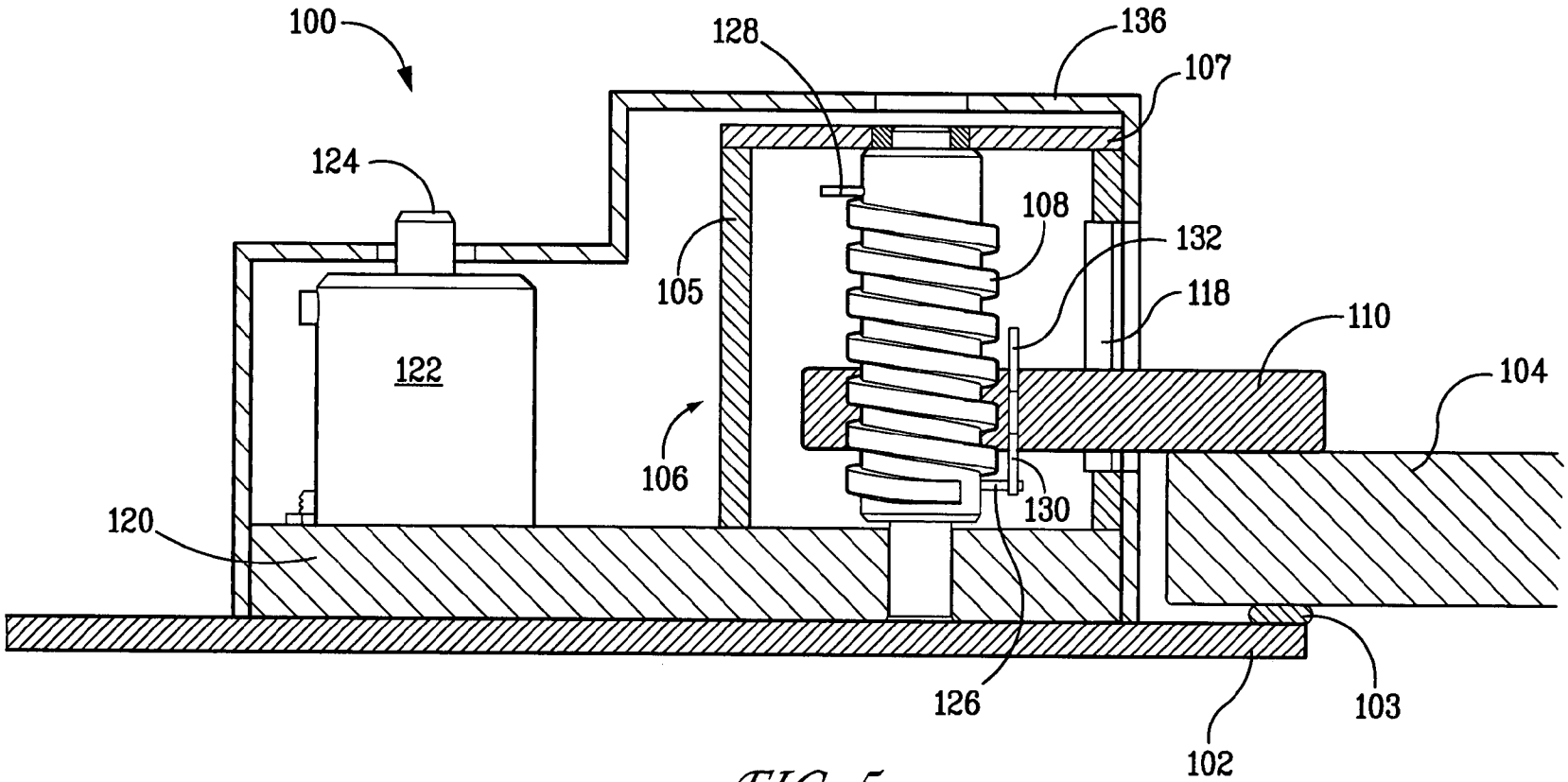
FIG. 5 is an environmental, partial cross sectional view showing a door-mountable electromechanical latch of the electromechanical latching system of the present invention installed on the door with the electromechanical latching system securing the door in the closed position.
Figure 7:
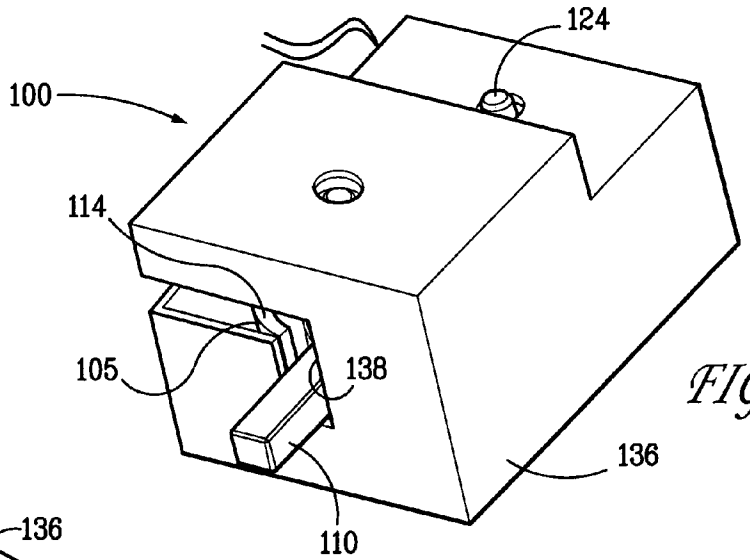
FIGS. 6 and 7 are perspective views showing a door-mountable electromechanical latch of the electromechanical latching system of the present invention in the closed position.
Figure 6:
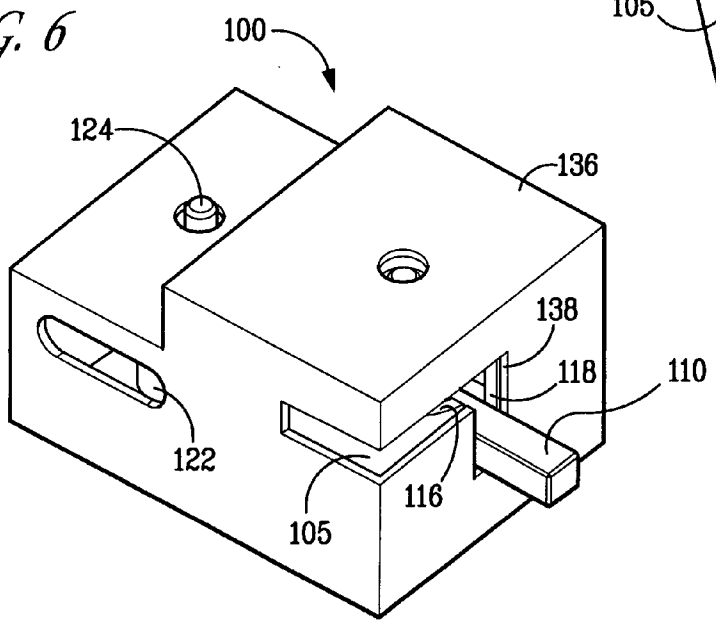
Figure 8:
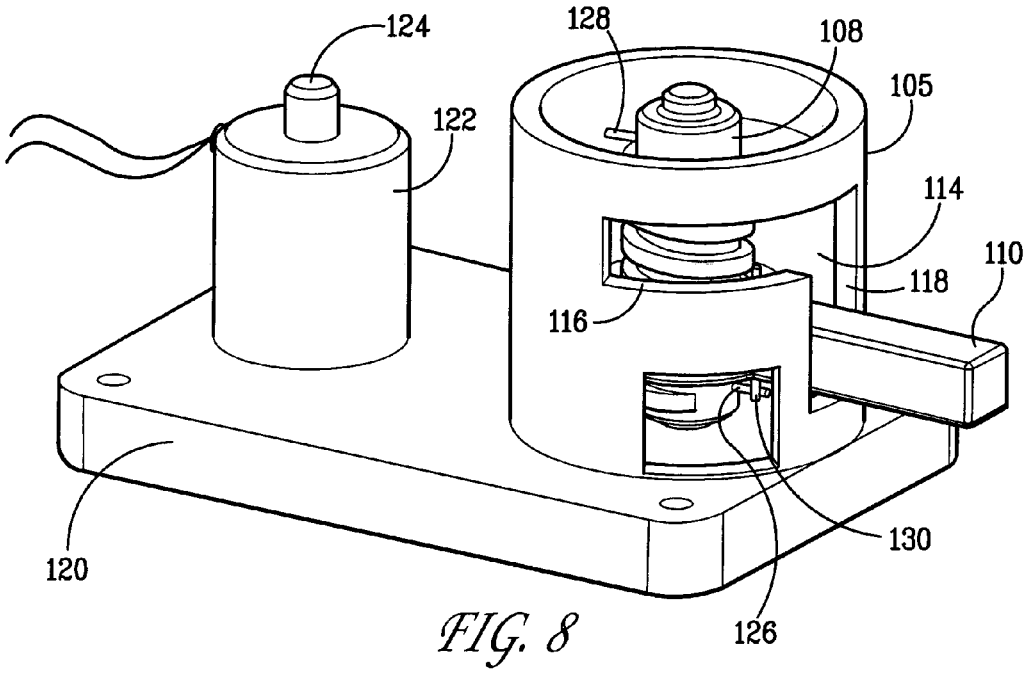
FIGS. 8 and 9 are perspective views showing a door-mountable electromechanical latch of the electromechanical latching system of the present invention in the closed position with the outer cover removed.
Figure 9:
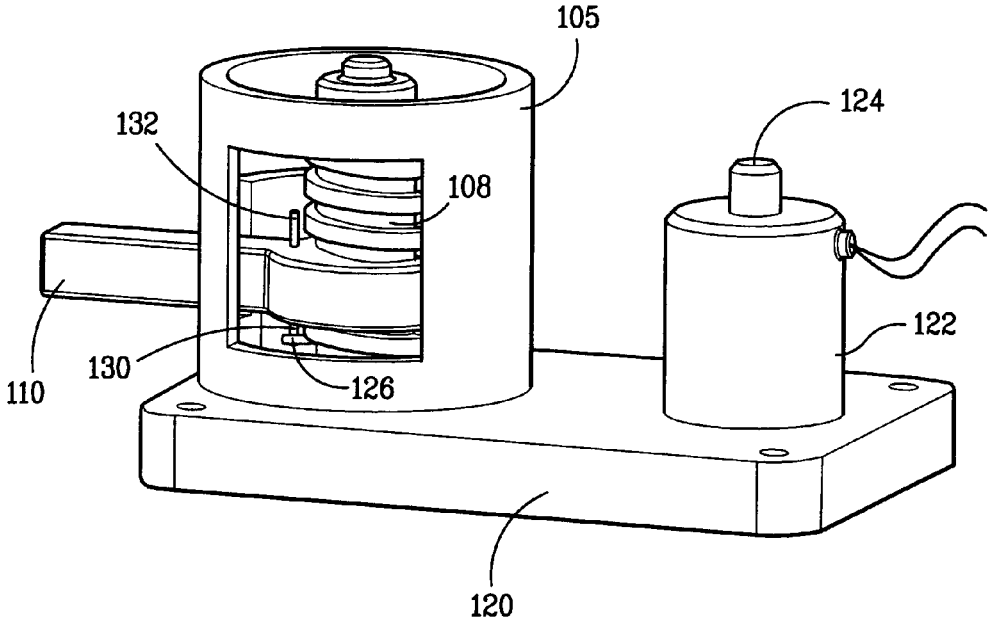
Figure 10:
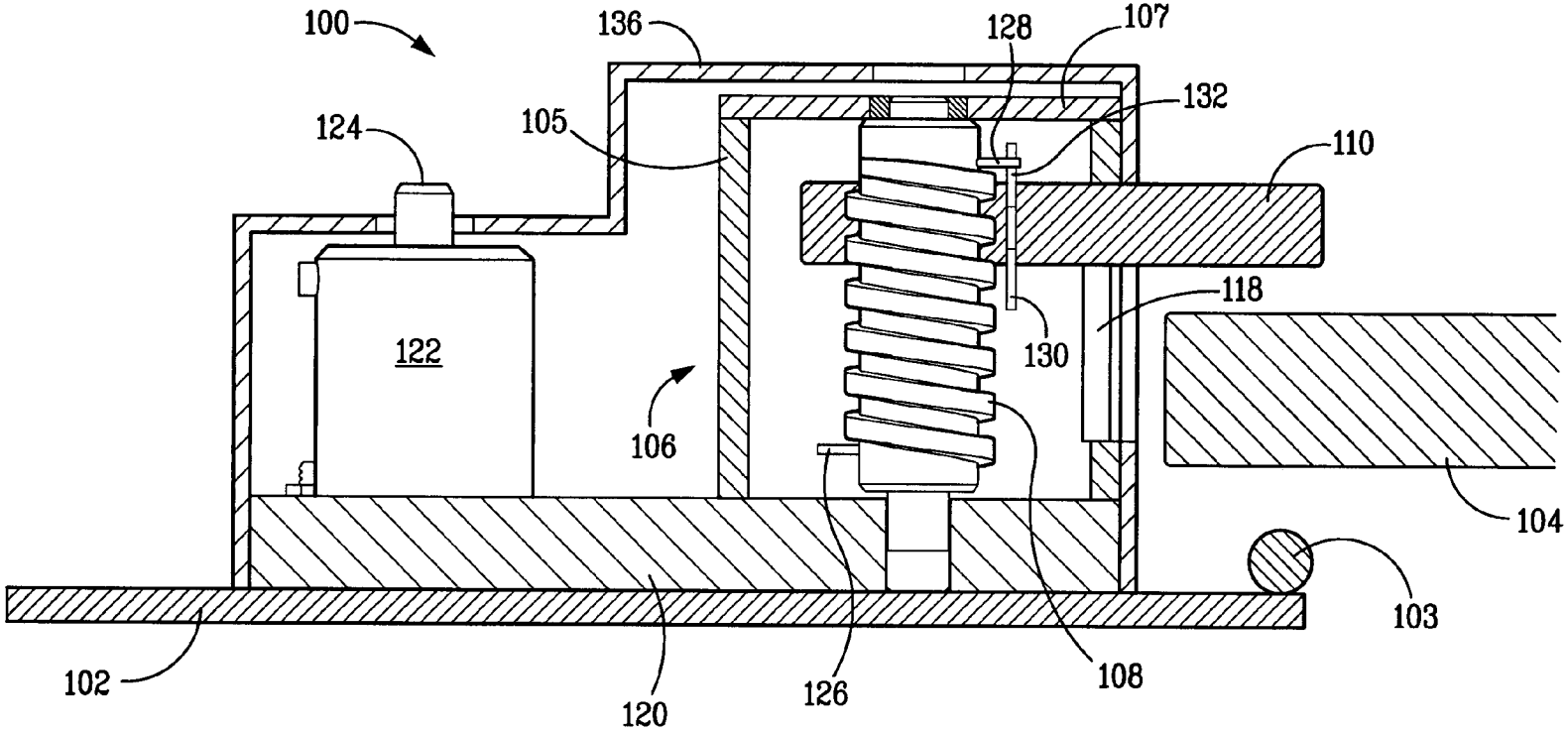
FIG. 10 is an environmental, partial cross sectional view showing a door-mountable electromechanical latch of the electromechanical latching system of the present invention installed on the door with the electromechanical latch in an intermediate position.
Figure 11:
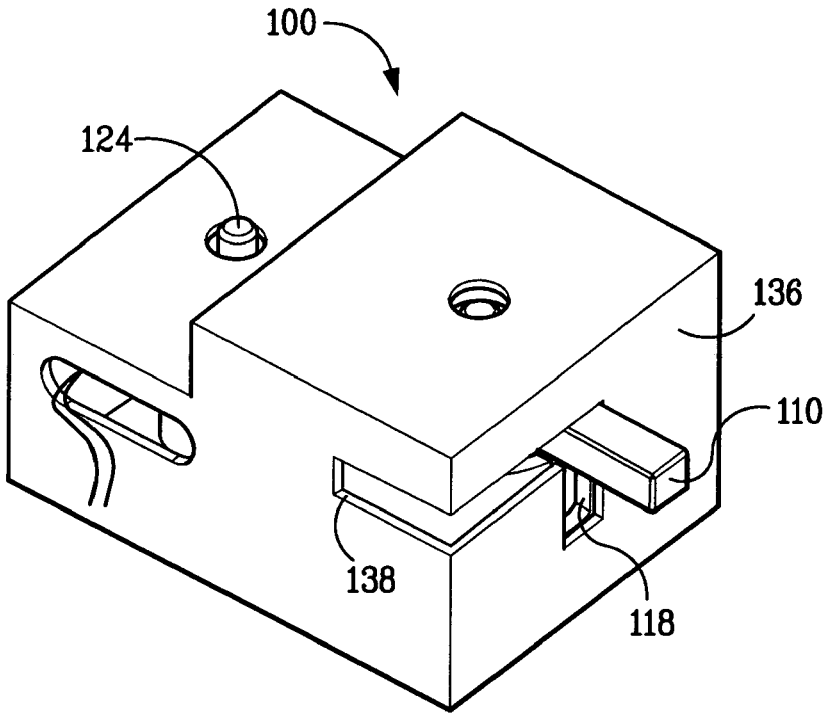
FIGS. 11 and 12 are perspective views showing a door-mountable electromechanical latch of the electromechanical latching system of the present invention in the intermediate position.
Figure 12:
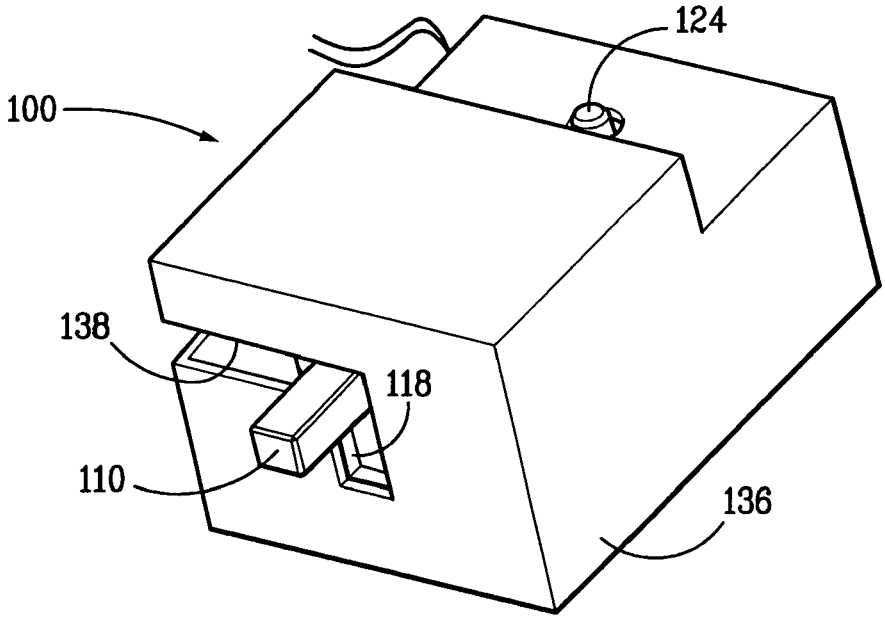
Figure 13:
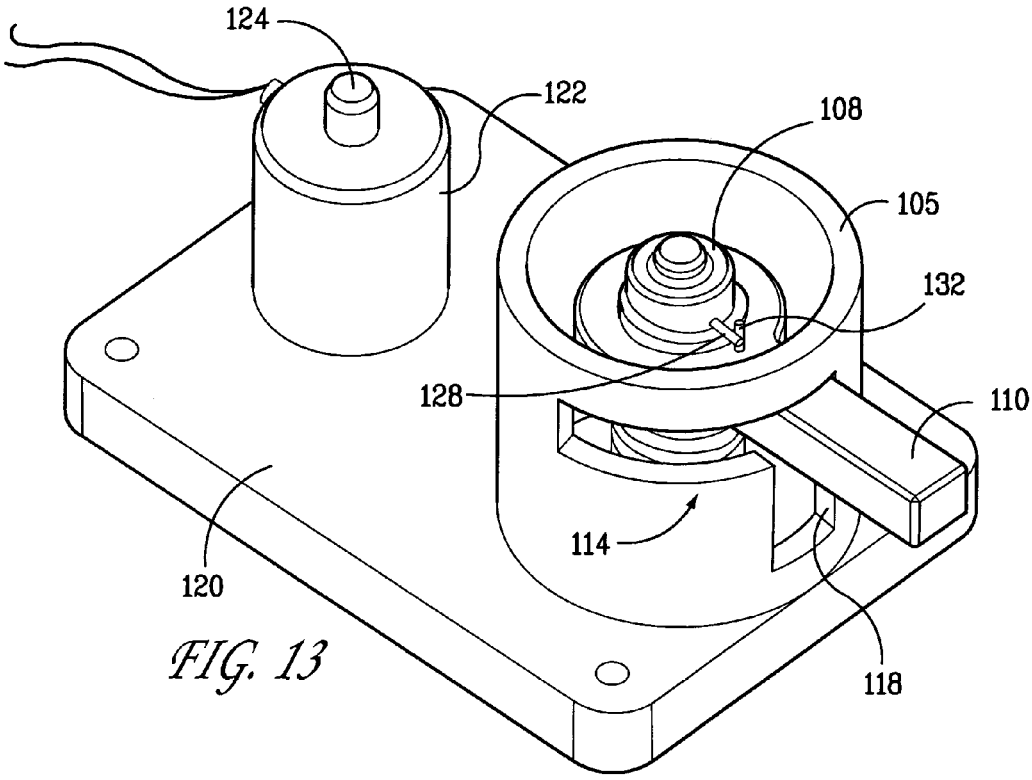
FIGS. 13 and 14 are perspective views showing a door-mountable electromechanical latch of the electromechanical latching system of the present invention in the intermediate position with the outer cover removed.
Figure 14:
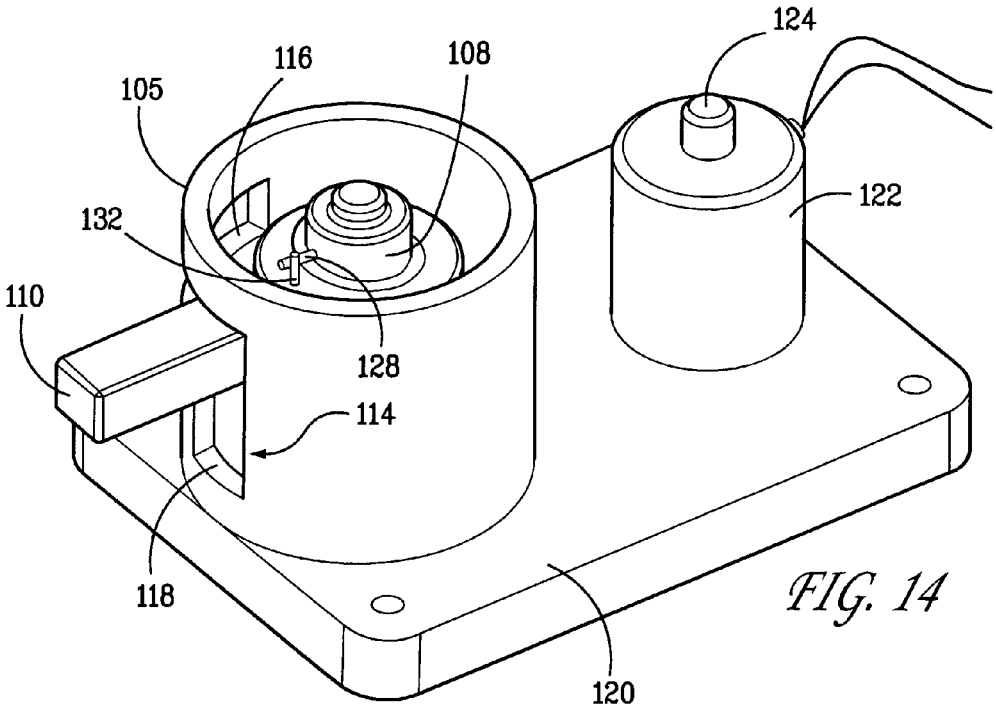
Figure 15:
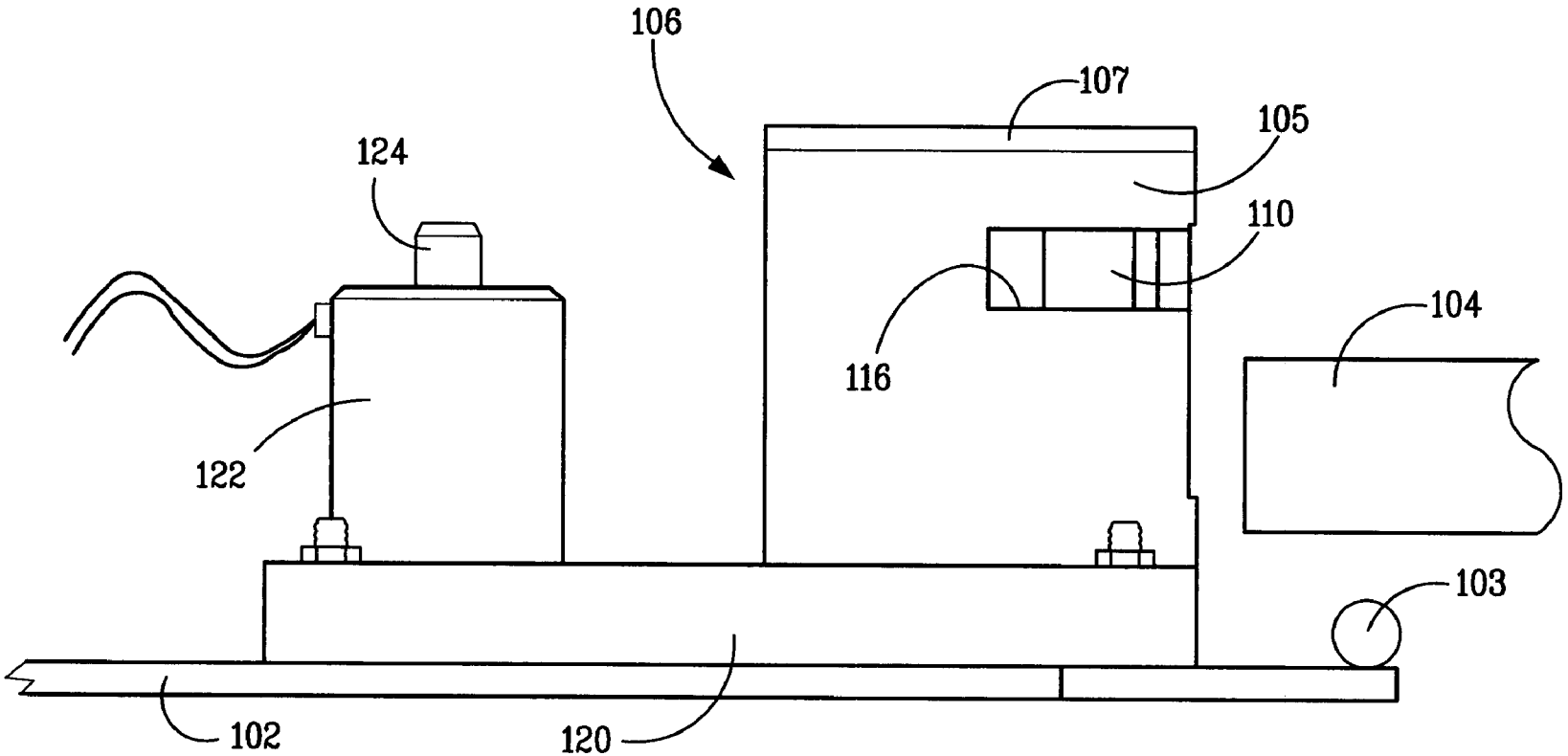
FIG. 15 is an environmental view showing a door-mountable electromechanical latch of the electromechanical latching system of the present invention with the outer cover removed and installed on the door with the electromechanical latch in the open position.
Figure 16:
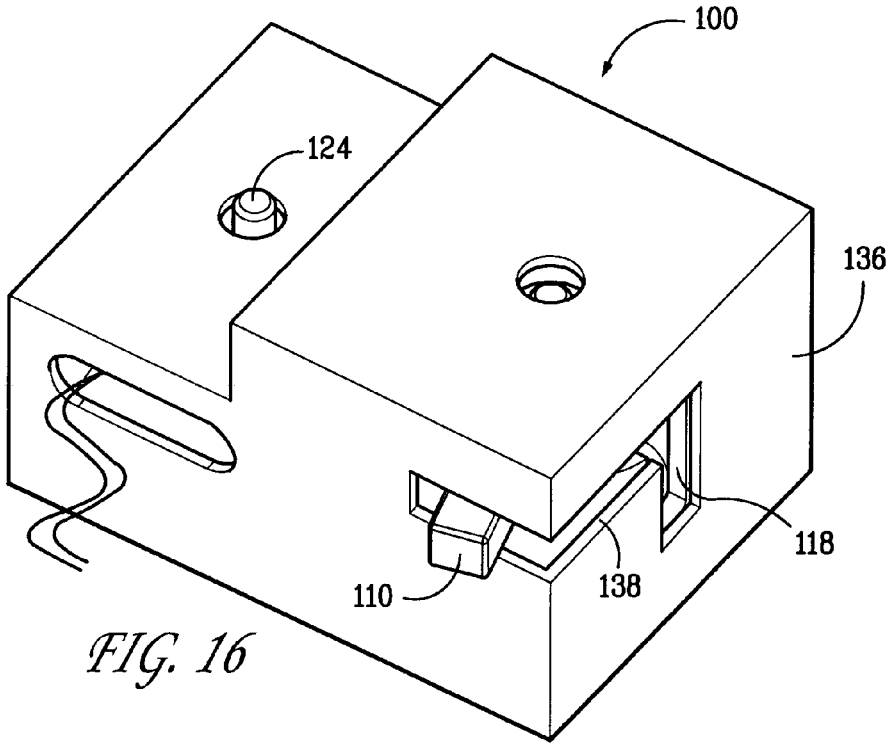
FIGS. 16 and 17 are perspective views showing a door-mountable electromechanical latch of the electromechanical latching system of the present invention in the open position.
Figure 17:
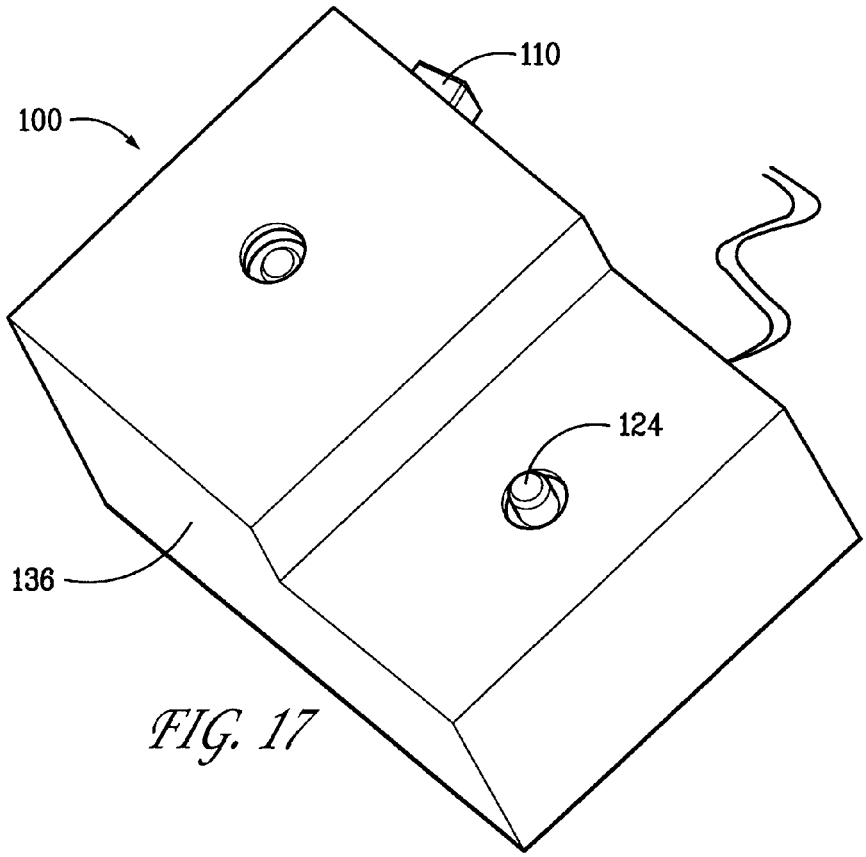

Referring to FIGS. 1–23, the present invention is directed to a latch that is particularly suited for releasably securing a first member relative to a second member. For example, the latch of the present invention can be used to releasably secure a door against a doorframe. An illustrative embodiment 100 of the latch of the present invent is shown in the drawing figures.

In the illustrative embodiment the latch 100 is used to secure the door 102 against a doorframe 104. The latch includes a housing 106 that supports the threaded shaft or screw 108 such that the screw 108 is free to rotate about its own longitudinal axis. In the illustrated embodiment the housing 106 has a cylindrical portion 105 and an end wall 107. The latch has a pawl 110 that is supported by the screw 108. The pawl 110 has a threaded hole that is engaged by the threads of the screw 108 such that when the pawl is prevented from rotation, the rotation of the screw will move the pawl 110 in the direction of the longitudinal axis of the screw 108. The pawl 110 has a distal end 112 adapted to engage a doorframe or a keeper fixed to the doorframe to hold the door closed when the pawl and door are in the closed position. The distal end 112 passes to the exterior of the housing 106 through an L-shaped slot 114 in the housing wall. The L-shaped slot 114 has a longitudinal portion and a transverse portion. When the pawl 110 is in the longitudinal portion of the slot 114, the pawl moves parallel to the longitudinal axis of the screw 108 in response to the rotation of the screw 108. Note that depending upon the direction of the rotation of the screw 108, one of the edges of the longitudinal portion of the slot 114 acts on the pawl 110 to prevent the rotation of the pawl 110 as the pawl 110 moves parallel to the longitudinal axis of the screw 108 in response to the rotation of the screw 108. When the pawl 110 is in the transverse portion of the slot 114, the pawl moves rotationally about the longitudinal axis of the screw 108 in response to the rotation of the screw 108.

As an alternative to the L-shaped slot 114, a cutout having roughly uniform width throughout its length, the length being the dimension parallel to the longitudinal axis of the screw 108, can be provided in the wall of the housing 106. In such a case, a compression coil spring may be provided between the housing and the pawl and around the screw 108. The spring would enhance the frictional force between the threads of the screw 108 and the pawl 110 such that the pawl will rotate with the screw when the pawl is not abutting a side of the cutout that is parallel to the longitudinal axis of the screw 108.

In the open position (shown in FIGS. 15–19), the pawl 110 is situated at the end of the transverse portion 116 of the slot 114 that is distal from the longitudinal portion 118 of the slot 114. In the open position, the pawl is clear of the doorframe. Rotation of the screw 108 moves the pawl 110 into registry with the longitudinal portion 118 of the slot 114 where the longer longitudinal side or edge of the slot portion 118 prevents further rotation of the pawl 110. With the door closed and the pawl in this intermediate position (shown in FIGS. 10–14), the pawl overlaps the door frame such that the doorframe will interfere with the pawl if opening the door is attempted. Then as the screw 108 continues to rotate, the pawl moves longitudinally, i.e. parallel to the longitudinal axis of the screw 108, until the pawl contacts the door frame and pulls up the door against the doorframe. Thus, latch 100 applies a compressive force between the door and the doorframe. This type of compressive force is useful in sealing the door 102 against the doorframe 104, especially when, for example a compressible gasket 103 is provided between the door and doorframe (see FIGS. 2, 4–9, and 24). To move the pawl 110 to the open position, the rotation of the screw 108 is reversed until the pawl is once again in the open position and the door can be opened. Reversing the rotation of the screw reverses the sequence of the movements of the pawl as described for the closing operation. Many of the mechanical aspects of the operation of the latch 100 are similar to the latch disclosed in U.S. Pat. No. 3,302,964, the entire disclosure of which is incorporated herein by reference.

The latch 100 also includes a gearbox 120 and motor 122. Motor shaft 124 is connected to the input end of the reducing speed (also known as increasing torque) gearbox 120. Latch screw 108 is connected to the output end of the gearbox 120. Main components of latch are housing 106, screw 108, female threaded pawl 110 and four pins 126, 128, 130, and 132. Two pins 126 and 128 are attached to the either end of the threaded portion of the screw 108 inside the housing in such a way that the longitudinal axis of each pin is perpendicular to the longitudinal axis of the screw 108. Other two pins 130, 132 are attached to the pawl, one on each flat side. Here pins 130 and 132 are parallel to the longitudinal axis of the screw 108. Housing has an L-shaped slot 114 to guide the pawl travel.

Figure 18:
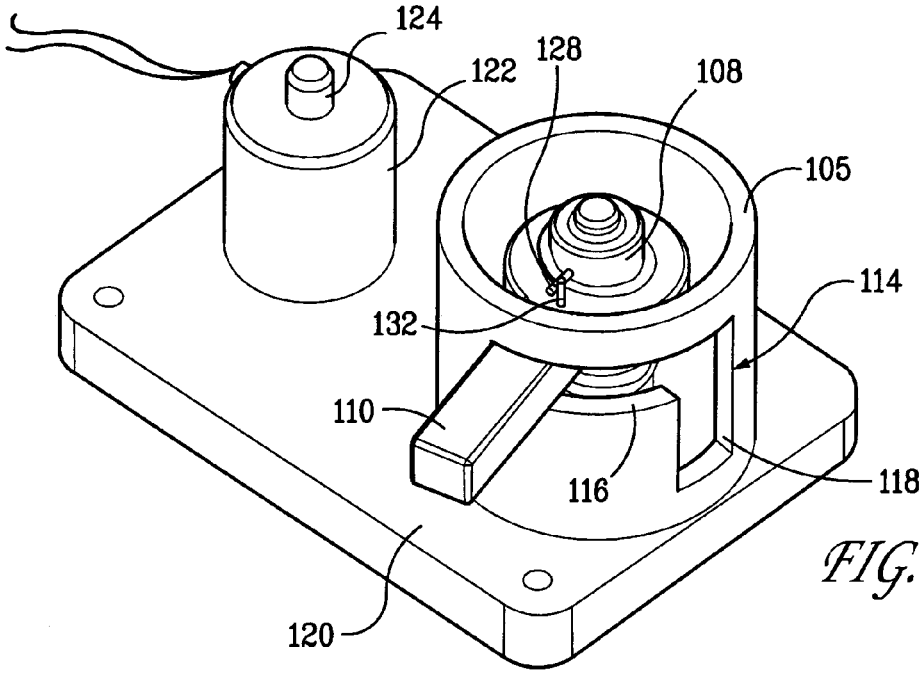
FIGS. 18 and 19 are perspective views showing a door-mountable electromechanical latch of the electromechanical latching system of the present invention in the open position with the outer cover removed.
Figure 19:
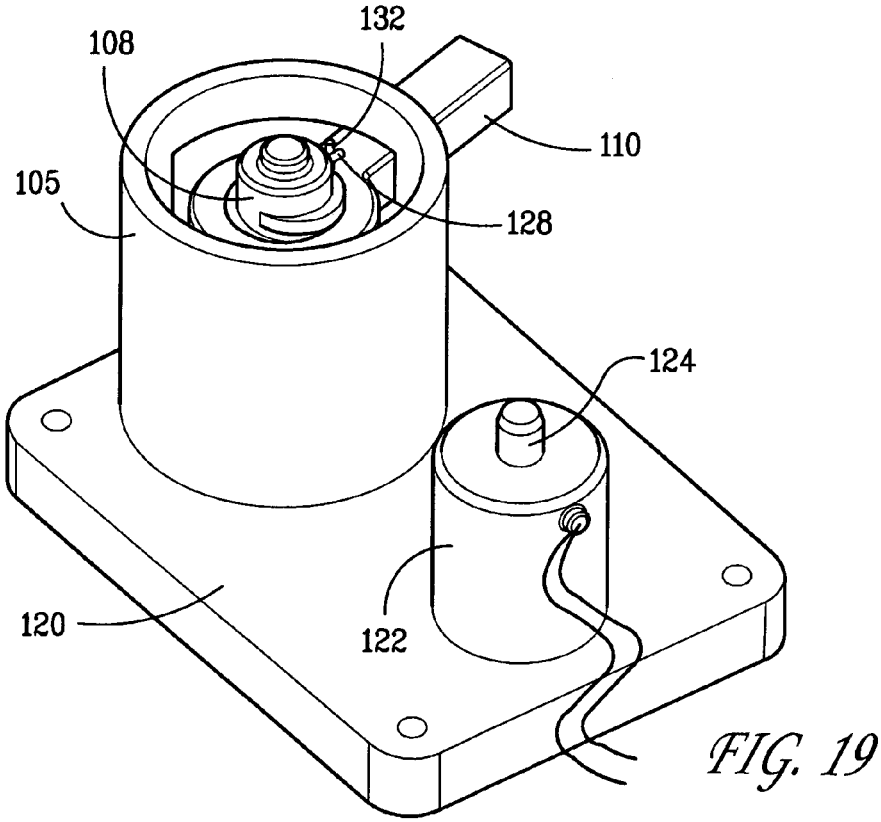
Figure 20:
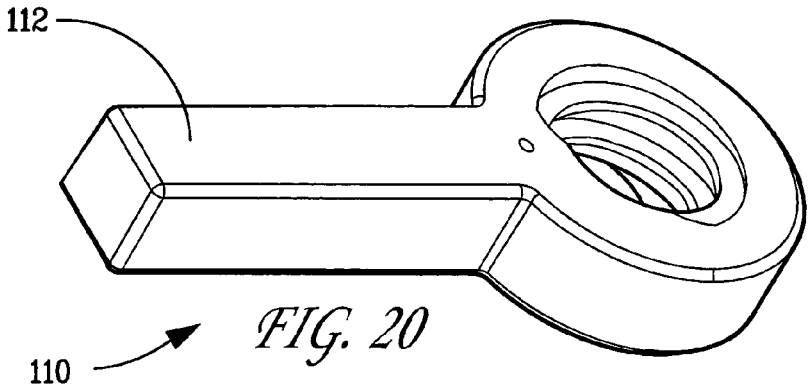
FIG. 20 is a perspective view showing the latch pawl of the electromechanical latch of the electromechanical latching system of the present invention.
Figure 21:
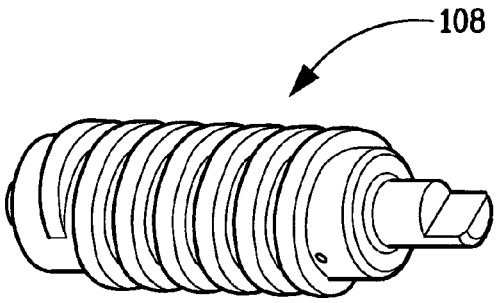
FIGS. 21 to 23 are views of the drive screw of the electromechanical latch of the electromechanical latching system of the present invention.
Figure 22:
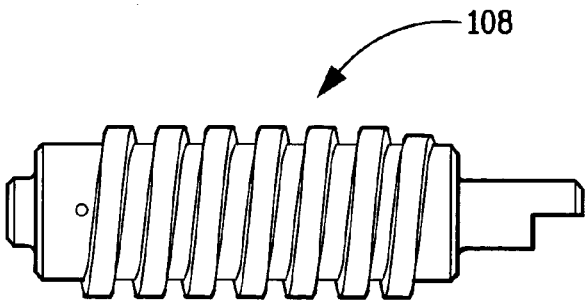
Figure 23:
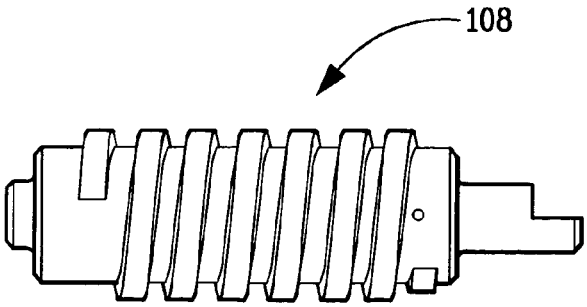

Assume that latch is in released position (door open) and pawl is in the corner of the transverse slot portion 116 distal from the longitudinal slot portion 118 as shown in FIGS. 18–19. When the motor is energized, rotary motion of motor will be transferred to the screw 108 via gearbox 120. If this motion is in the proper direction, pawl will initially rotate until it contacts the longer edge of the longitudinal slot portion 118 and then starts traveling in the longitudinal slot portion 118 until the pawl pin 130 makes contact with the screw pin 126 located nearer to the gearbox 120. This will end the rotation of the screw 108 and thus the rotation of the gears and the motor. Motor will still remain energized until power to the motor gets turned off. When the rotation of the screw 108 is reversed, the pawl 110 will travel in the longitudinal slot portion 118 toward the transverse slot portion 116 until the pawl pin 132 makes contact with the screw pin 128 located farther from the gearbox 120. Once aligned with the transverse slot portion 116 the pin 128 makes contact with the pin 132 and the pawl and the screw 108 rotate together until the pawl is once again located in the corner of the transverse slot portion 116 distal from the longitudinal slot portion 118. At this point the rotation of the pawl is stopped by the closed end of the transverse slot portion 116 and the pawl acting through the contact between the pins 128 and 132 would stop the rotation of the gears as well as the rotation of the motor shaft. Again motor would have remained energized until power gets turned off. To change the rotation direction of the screw, power polarity has to be reversed. After reversing the polarity, if motor gets energized, the pawl will travel in the L-shaped slot 114 in the reverse of the sequence just described until once again the pins 126 and 130 make contact.

This arrangement provides a single point contact at either limit of the travel of the pawl 110 for stopping the rotation of the screw 108 and the movement of the pawl 110. By providing a single point contact for stopping the rotation of the screw 108 and the movement of the pawl 110, jamming of the pawl 110 at either limit of its travel is prevented without resorting to expensive feedback control systems to control the movement of the pawl 110.

Depending on the motor size this latch can generate substantial force. For demonstrated size of the latch 25 to 250 lbs force at the pawl contact point is easily attainable. Here door compression or release takes place only during energized condition. Energized time has to be minimized to prevent over-heating of the motor. A numeric keypad 134 may be used by a user to energize the motors 122 with the user selected polarity such that unauthorized access through the door is prevented.

In the illustrated embodiment, a protective cover 136 is provided that encloses the housing 106, motor 122, and the gearbox 120. The cover 136 also has an L-shaped slot 138 that provides clearance for the movement of the pawl 110. Either of the slots 114 and 138 can provide for the control of the motion of the pawl 110, provided the material of the cover 136 has enough wear resistance and toughness to meet the duty requirements of the latch 100.

Figure 24:
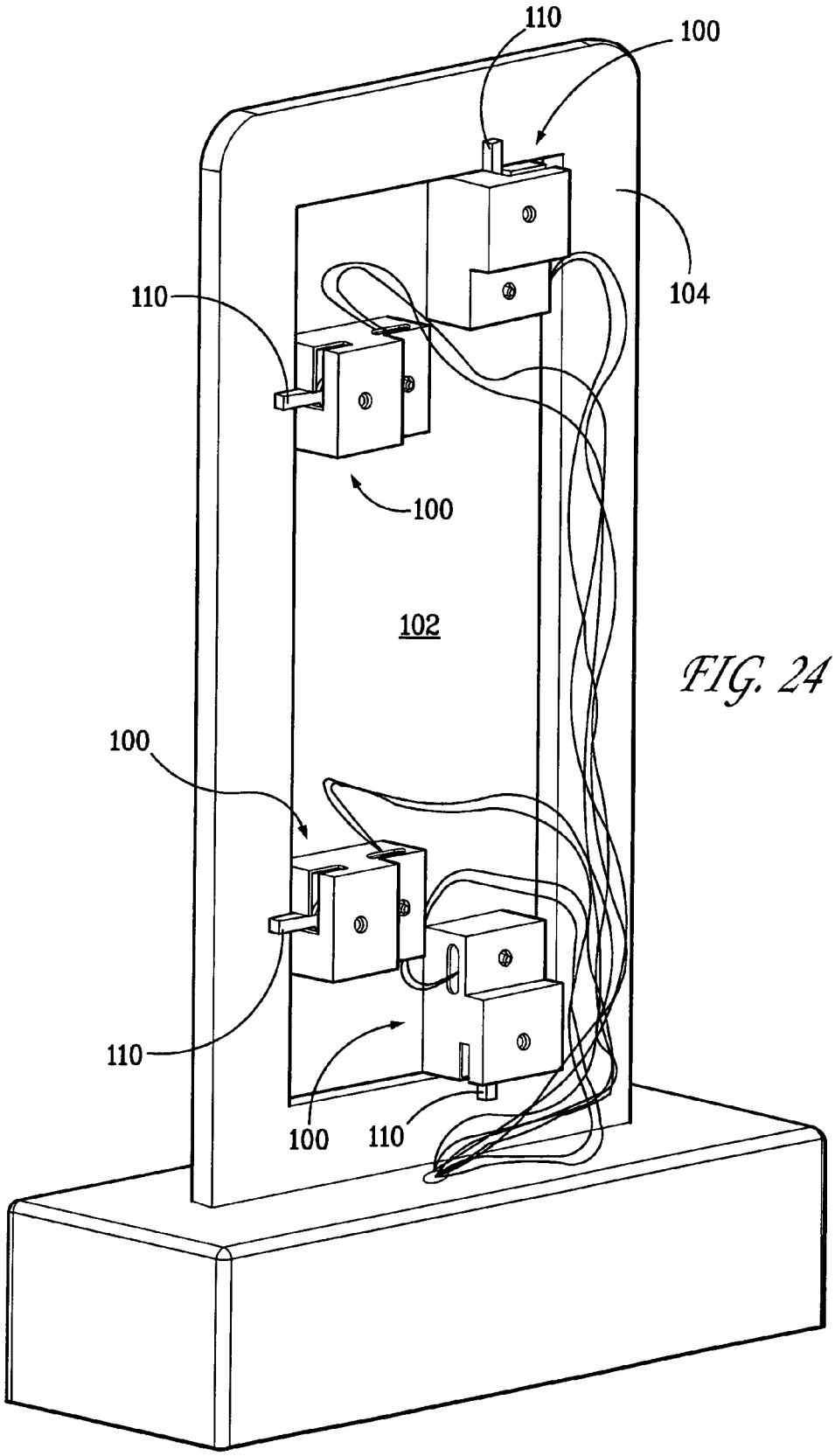
FIG. 24 is an environmental view showing a mock-up door and doorframe with a four-latch embodiment of the electromechanical latching system of the present invention installed on the door with the electromechanical latching system securing the door in the closed position.
Figure 25:
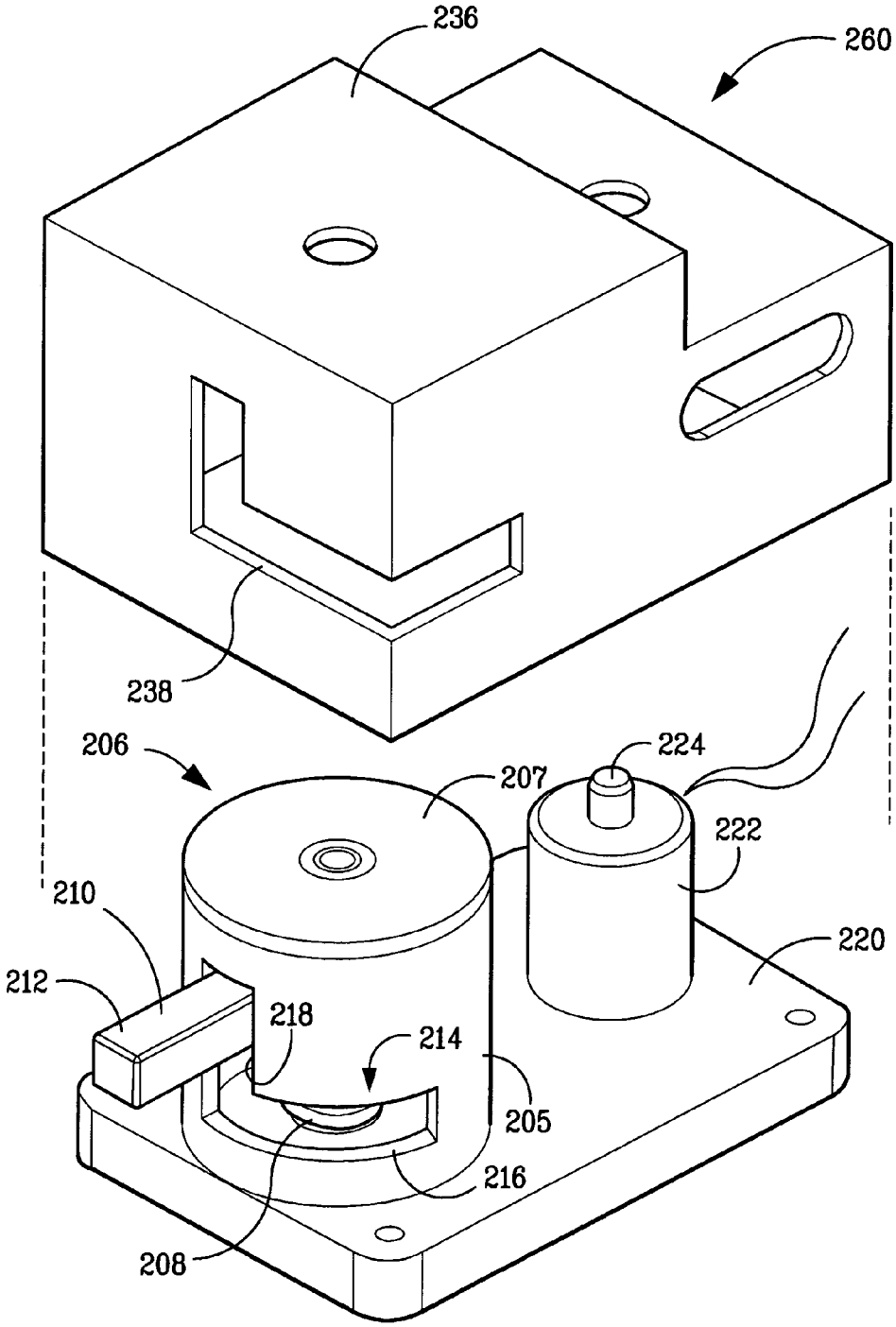
FIG. 25 is an exploded view showing a doorframe-mountable electromechanical latch of the electromechanical latching system of the present invention.

Referring to FIG. 24, a four-latch version of the latching system can be seen. The embodiment of FIG. 24 uses four latches 100, with two of the latches 100 being nearer the door hinge. With a purely mechanical compression latch, if the pawls 110 are displaced the same distance for all the latches, the pawls of the latches farthest from the door hinge will loose contact with the door frame because the door will be brought closer to the doorframe at locations that are farther from the axis of rotation of the door hinge. One advantage of the electromechanical latch 100 is that the motor will continue to move the pawl longitudinally until the pawl contacts the doorframe and the force experienced by the pawl is sufficient to counteract the torque of the motor. Thus all the electromechanical latches 100 will automatically displace their respective pawls to varying amounts such that all the pawls are in contact with the doorframe and exert equal compressive force on the gasket 103. This same advantage can be obtained with the doorframe-mountable version of the electromechanical latch 100 that is described below.

Referring to FIGS. 25–40, the present invention is directed to a latch that is particularly suited for releasably securing a first member relative to a second member. For example, the latch of the present invention can be used to releasably secure a door against a doorframe. An illustrative embodiment 200 of the latch of the present invent is shown in the drawing figures.

In the illustrative embodiment, the latch 200 is used to secure the door 202 against a doorframe 204. The latch includes a housing 206 that supports the threaded shaft or screw 208 such that the screw 208 is free to rotate about its own longitudinal axis. In the illustrated embodiment the housing 206 has a cylindrical portion 205 and an end wall 207. The latch has a pawl 210 that is supported by the screw 208. The pawl 210 has a threaded hole that is engaged by the threads of the screw 208 such that when the pawl is prevented from rotation, the rotation of the screw will move the pawl 210 in the direction of the longitudinal axis of the screw 208. The pawl 210 has a distal end 212 adapted to engage a door 202 or a keeper 201 fixed to the door to hold the door closed when the pawl and door are in the closed position. The distal end 212 passes to the exterior of the housing 206 through an L-shaped slot 214 in the housing wall. The L-shaped slot 214 has a longitudinal portion 218 and a transverse portion 216. When the pawl 210 is in the longitudinal portion 218 of the slot 214, the pawl moves parallel to the longitudinal axis of the screw 208 in response to the rotation of the screw 208. When the pawl 210 is in the transverse portion 216 of the slot 214, the pawl moves rotationally about the longitudinal axis of the screw 208 in response to the rotation of the screw 208.

As an alternative to the L-shaped slot 214, a cutout having roughly uniform width throughout its length, the length being the dimension parallel to the longitudinal axis of the screw 208, can be provided in the wall of the housing 206. In such a case, a compression coil spring may be provided between the housing and the pawl and around the screw 208. The spring would enhance the frictional force between the threads of the screw 208 and the pawl 210 such that the pawl will rotate with the screw when the pawl is not abutting a side of the cutout that is parallel to the longitudinal axis of the screw 208.

Figure 26:
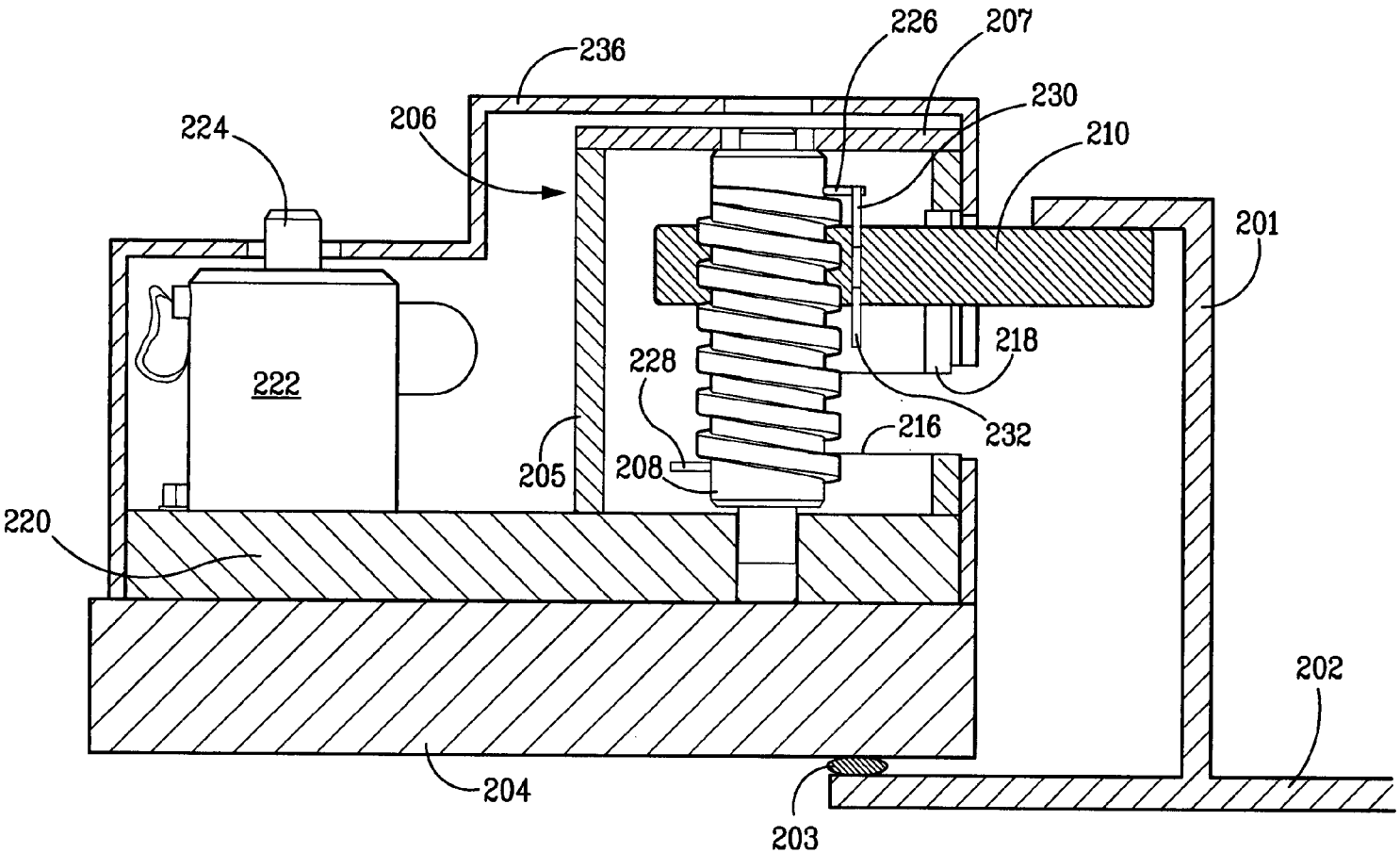
FIG. 26 is an environmental, partial cross sectional view showing a doorframe-mountable electromechanical latch of the electromechanical latching system of the present invention installed on the doorframe with the electromechanical latching system securing the door in the closed position.
Figure 27:
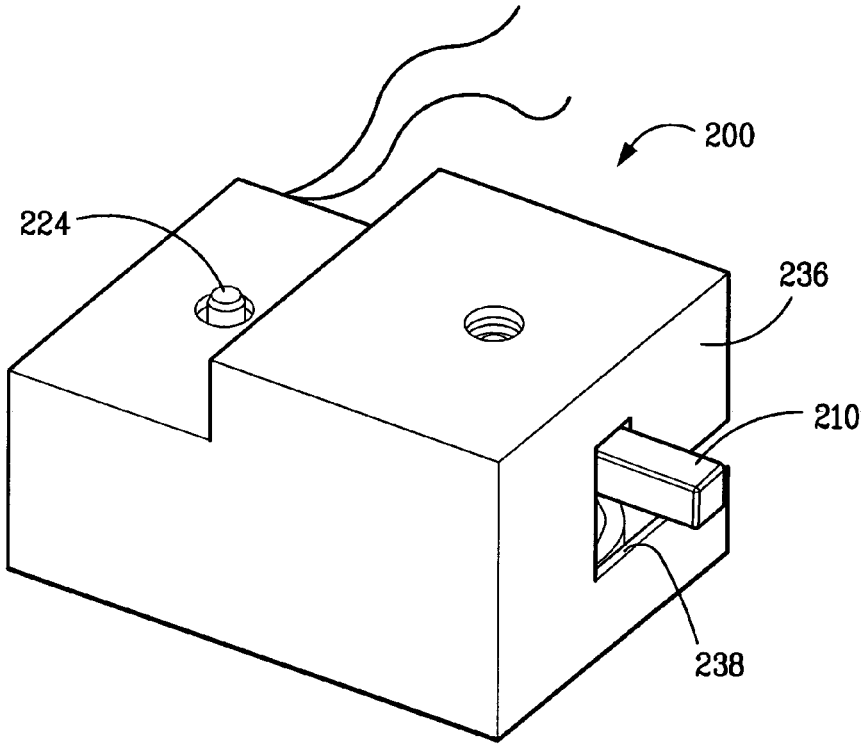
FIGS. 27 and 28 are perspective views showing a doorframe-mountable electromechanical latch of the electromechanical latching system of the present invention in the closed position.
Figure 28:
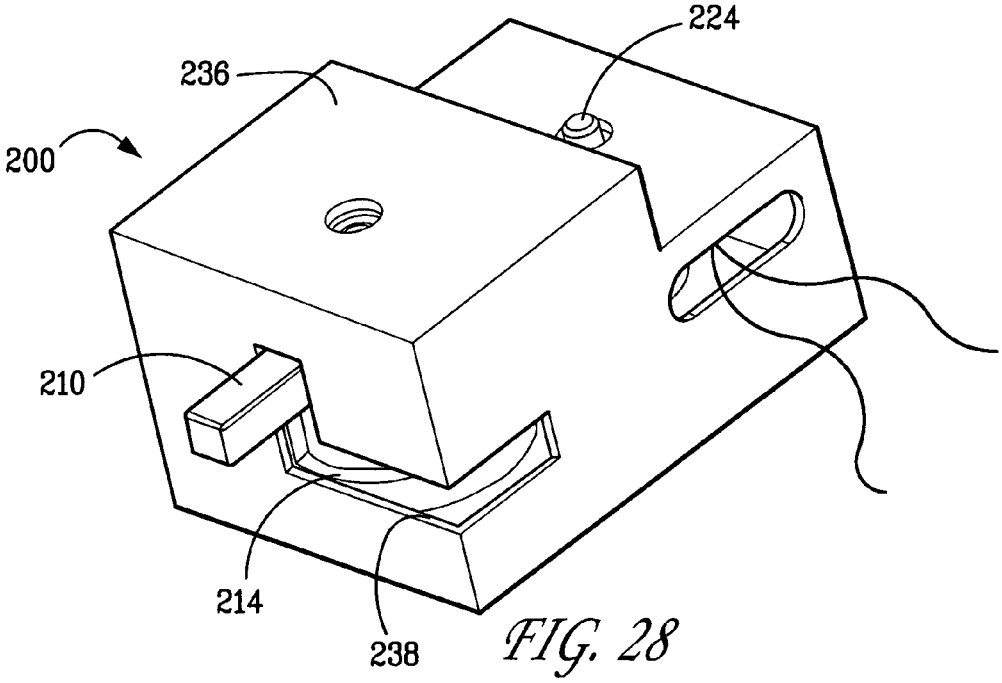
Figure 29:
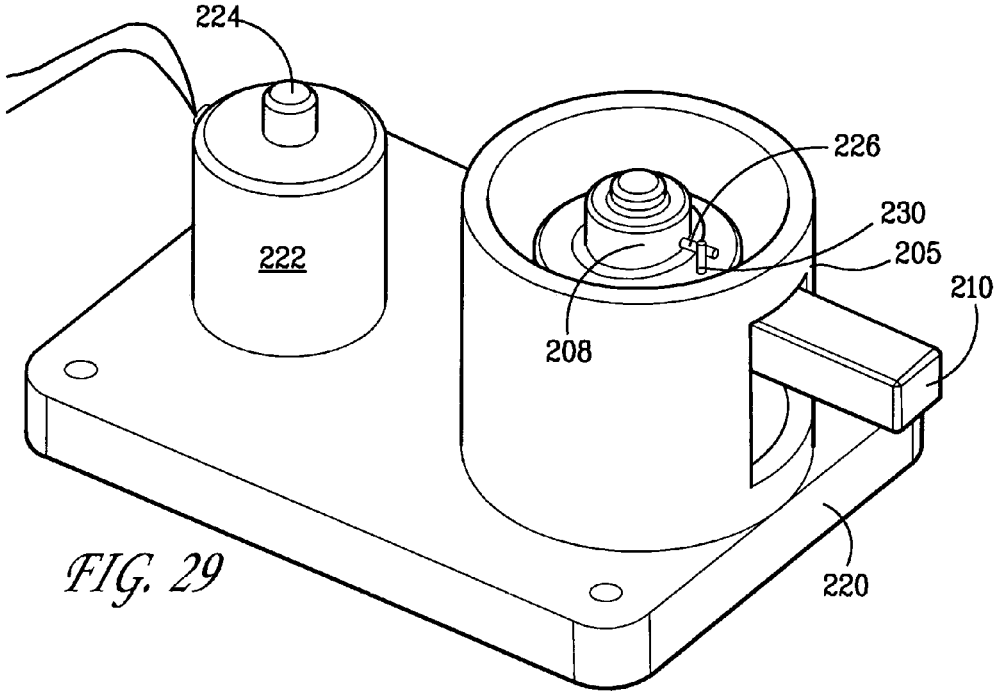
FIGS. 29 and 30 are perspective views showing a doorframe-mountable electromechanical latch of the electromechanical latching system of the present invention in the closed position with the outer cover removed.
Figure 30:
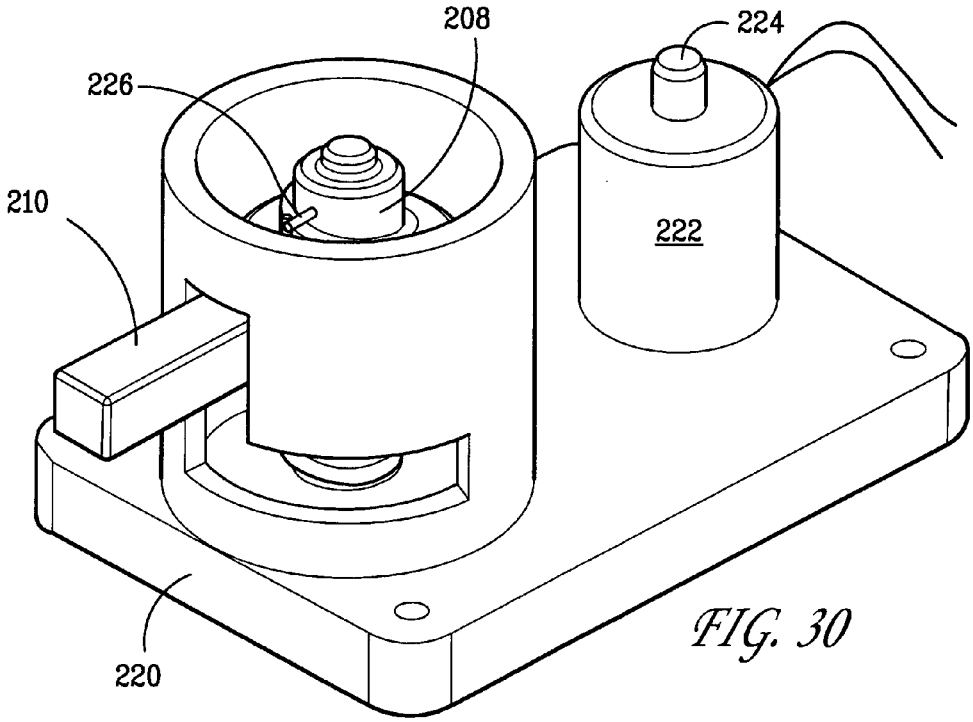
Figure 31:
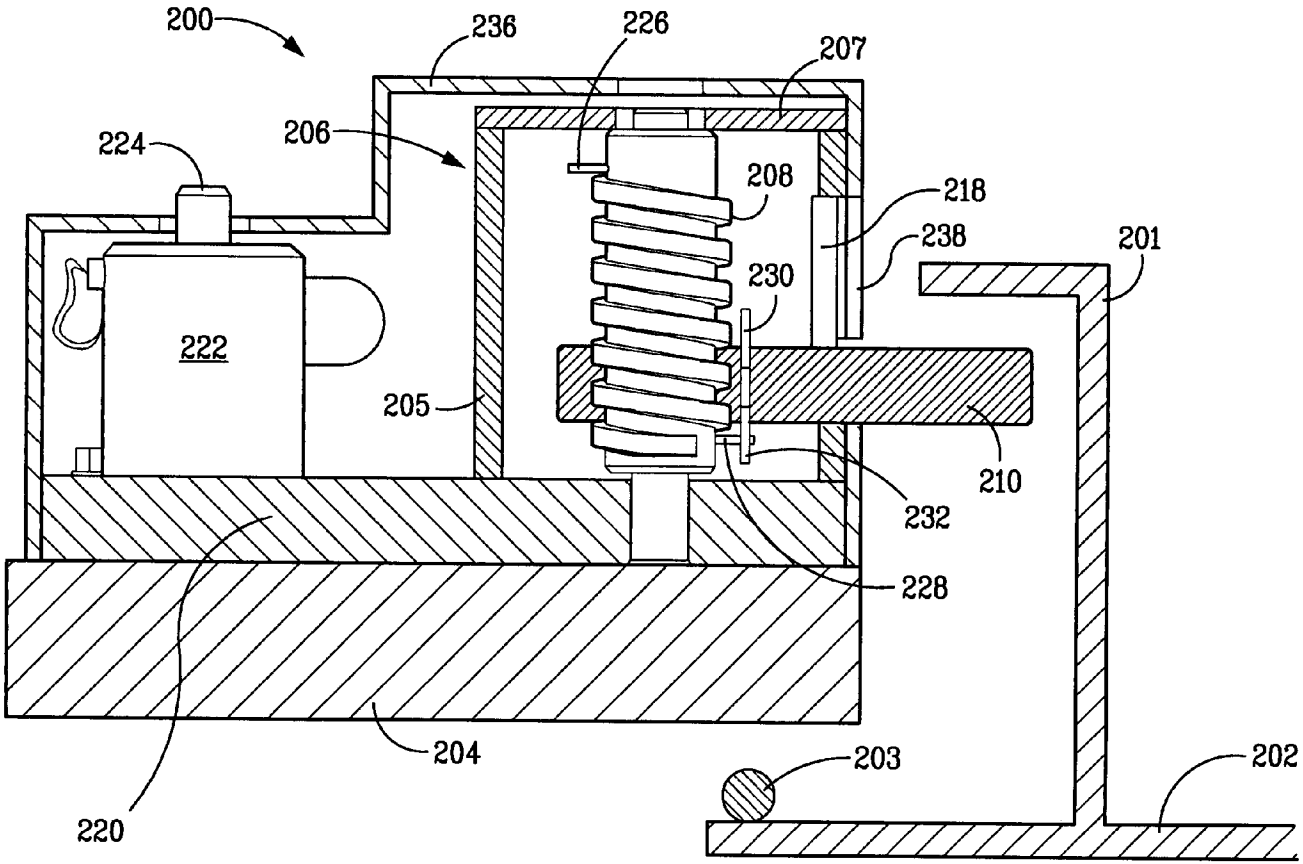
FIG. 31 is an environmental, partial cross sectional view showing a doorframe-mountable electromechanical latch of the electromechanical latching system of the present invention installed on the doorframe with the electromechanical latch in an intermediate position.
Figure 32:
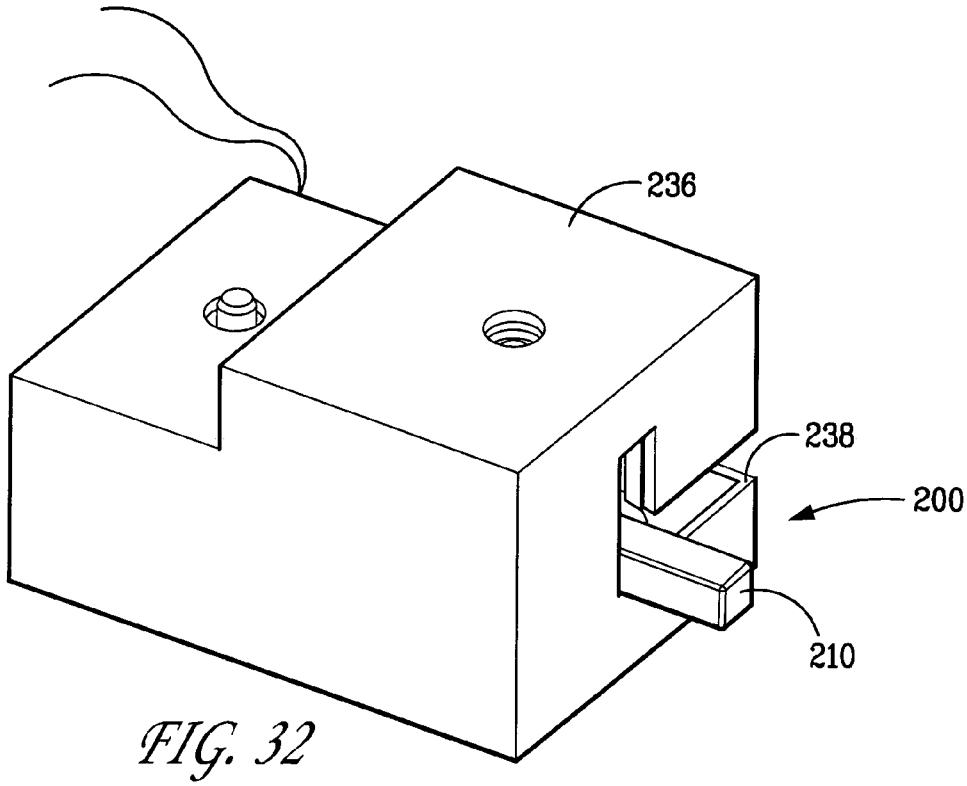
FIGS. 32 and 33 are perspective views showing a doorframe-mountable electromechanical latch of the electromechanical latching system of the present invention in the intermediate position.
Figure 33:
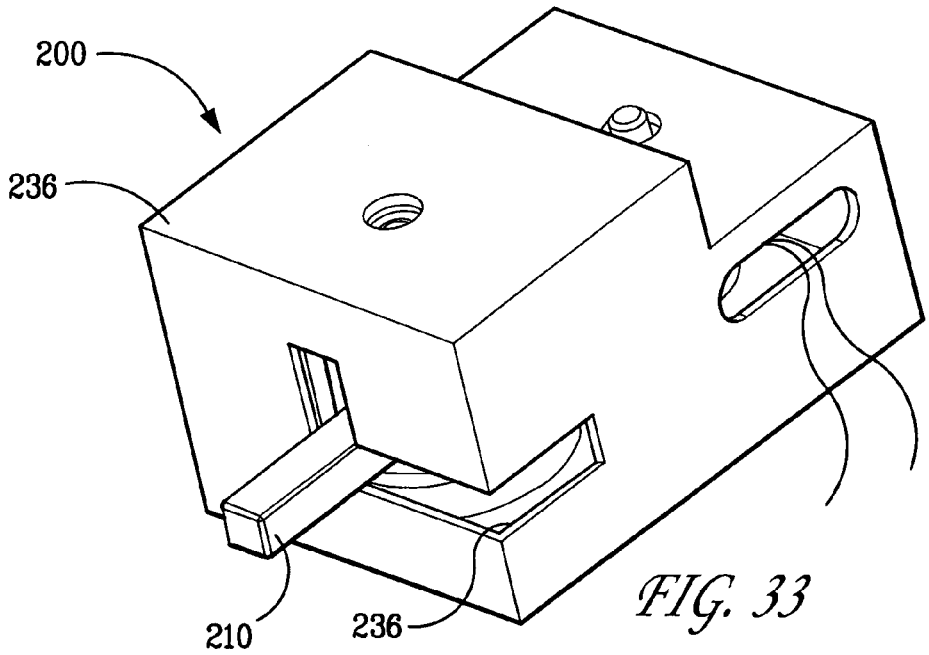
Figure 34:
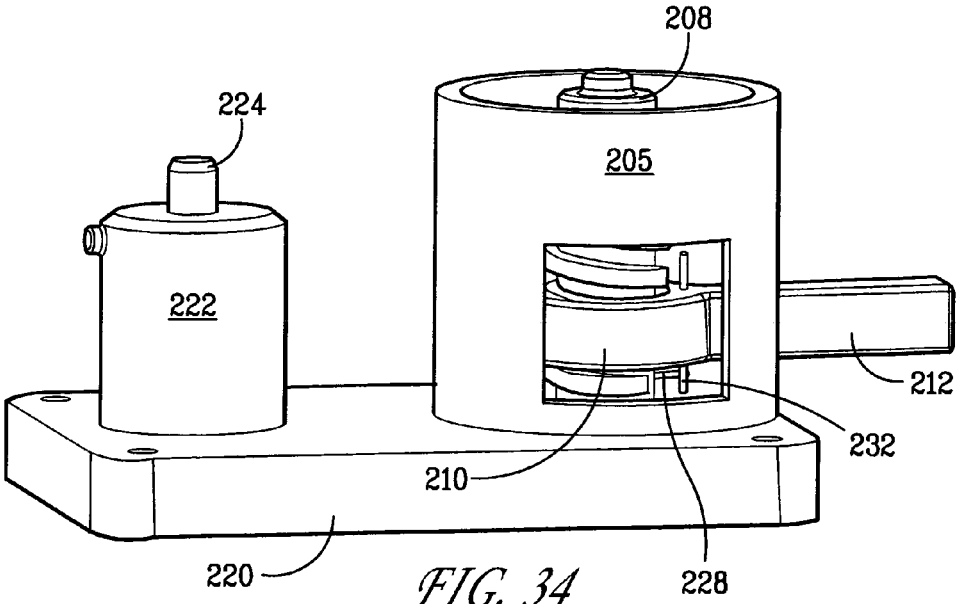
FIGS. 34 and 35 are perspective views showing a doorframe-mountable electromechanical latch of the electromechanical latching system of the present invention in the intermediate position with the outer cover removed.
Figure 35:
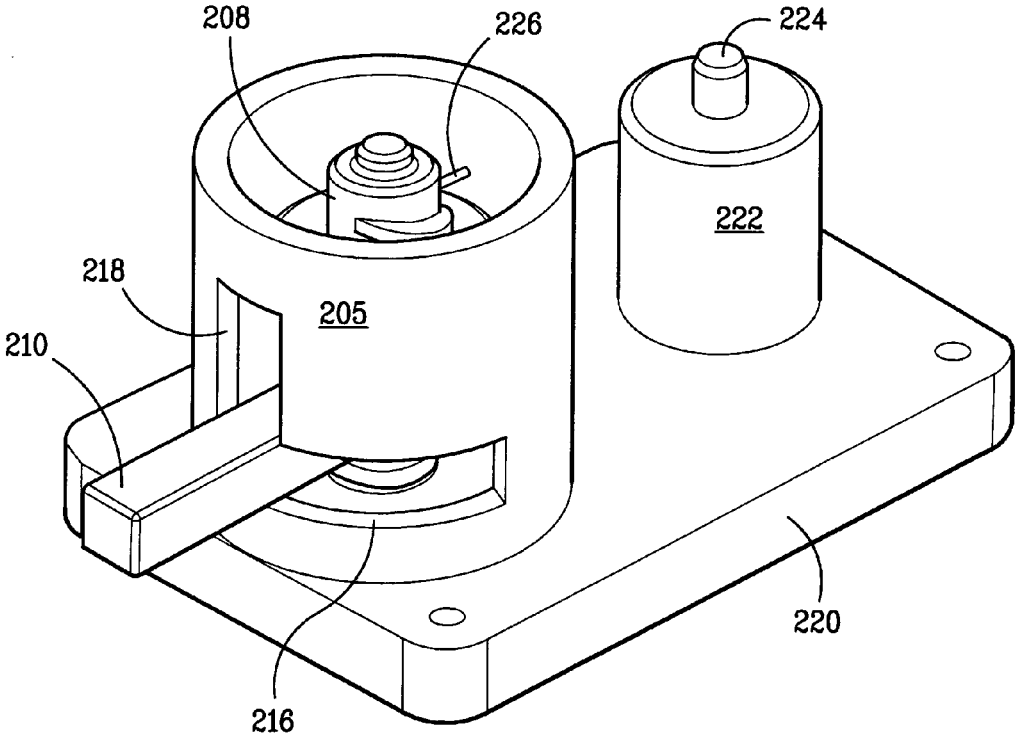
Figure 36:
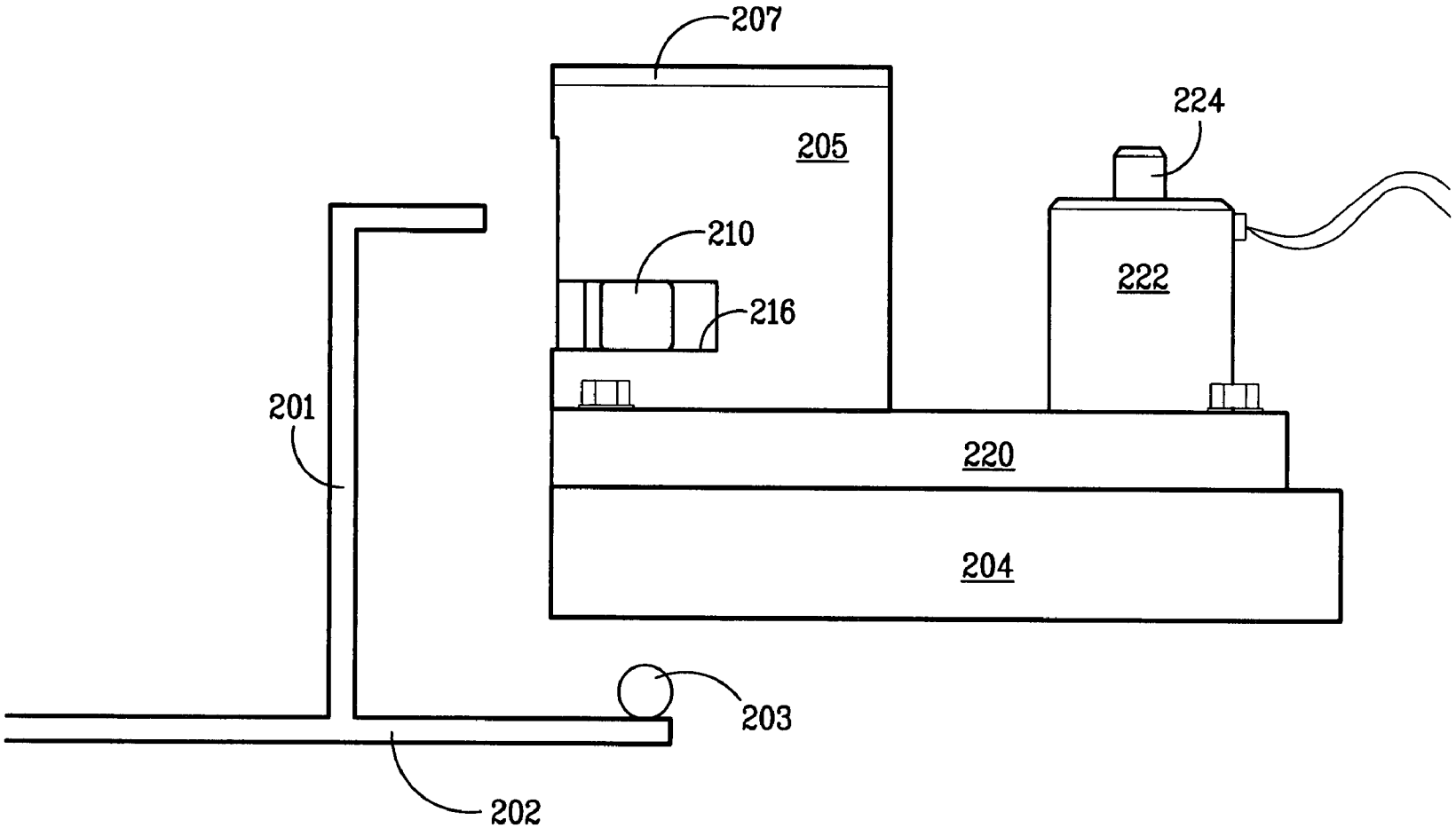
FIG. 36 is an environmental view showing a doorframe-mountable electromechanical latch of the electromechanical latching system of the present invention with the outer cover removed and installed on the doorframe with the electromechanical latch in the open position.
Figure 37:
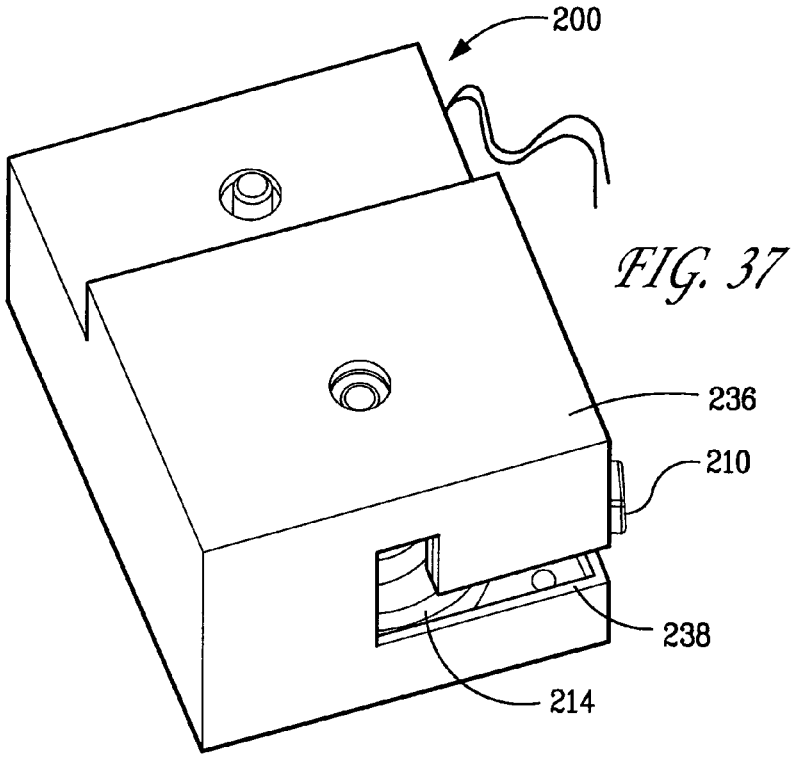
FIGS. 37 and 38 are perspective views showing a doorframe-mountable electromechanical latch of the electromechanical latching system of the present invention in the open position.
Figure 38:
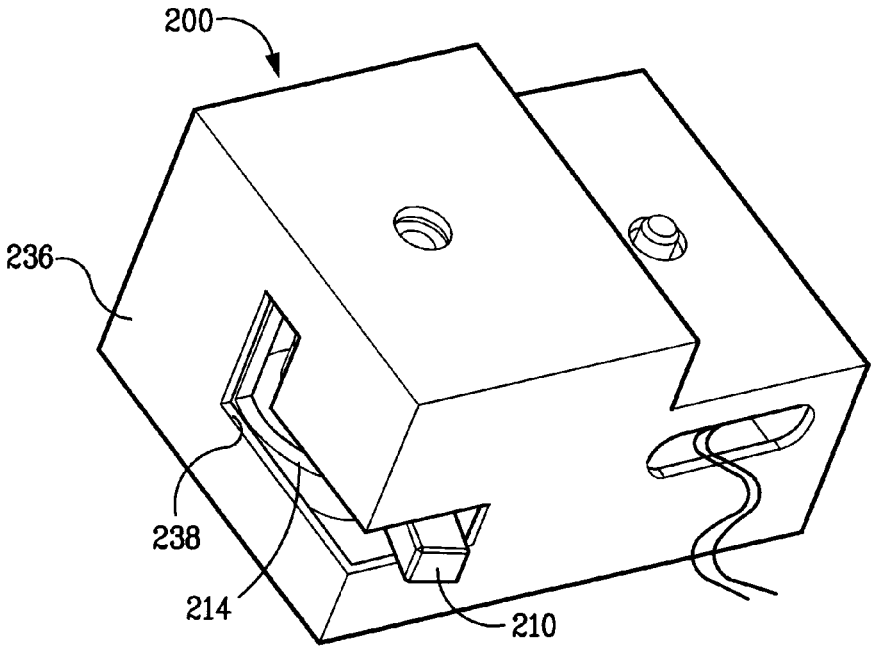
Figure 39:
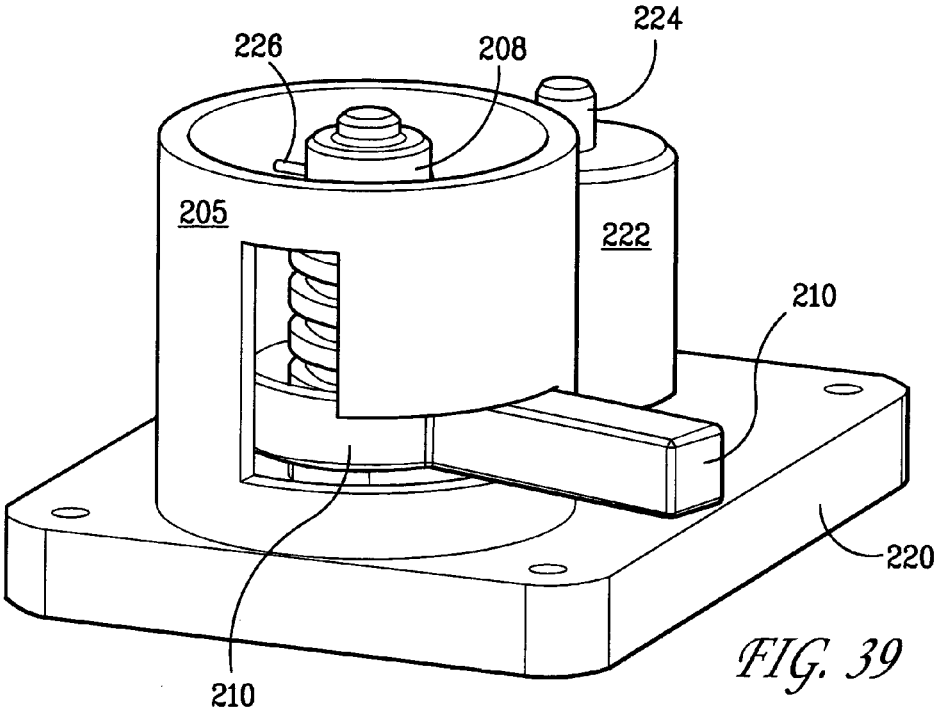
FIGS. 39 and 40 are perspective views showing a doorframe-mountable electromechanical latch of the electromechanical latching system of the present invention in the open position with the outer cover removed.
Figure 40:
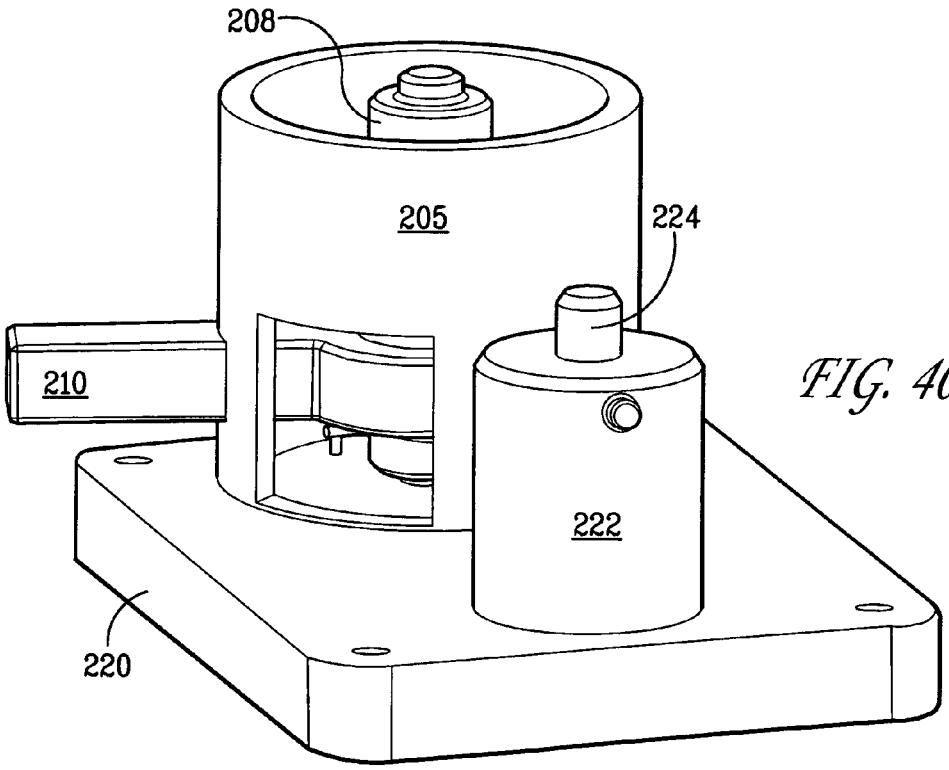
Figure 41:
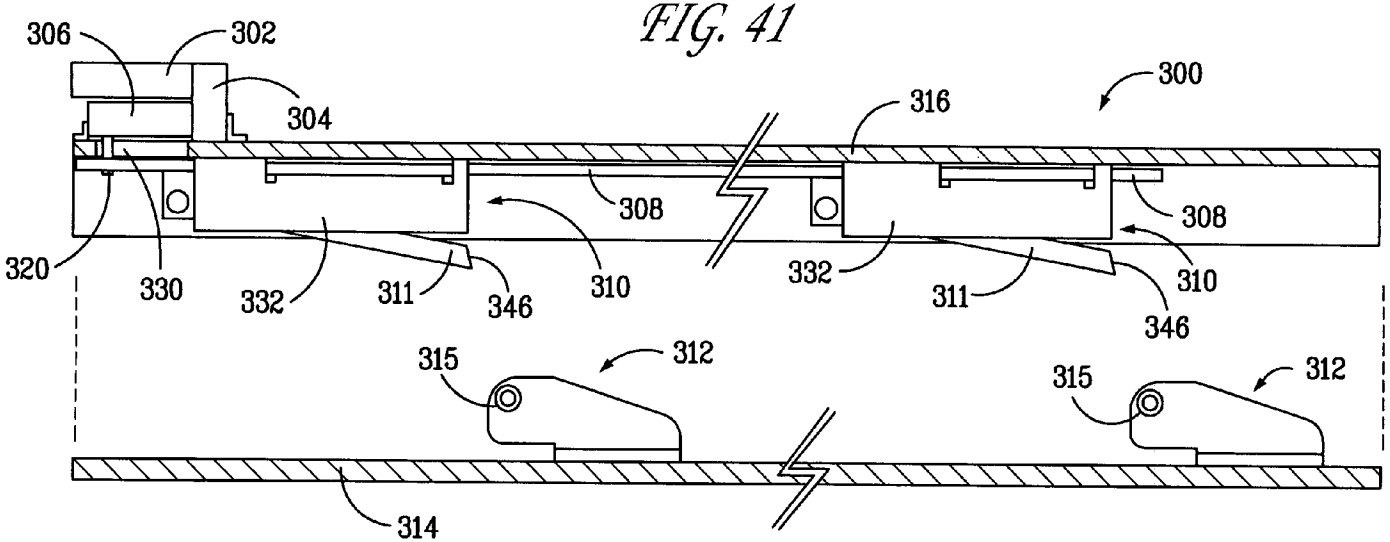
FIG. 41 is a cross sectional view showing the door of a cabinet equipped with the fourth embodiment of the latching system of the present invention in the open position.
Figure 42:
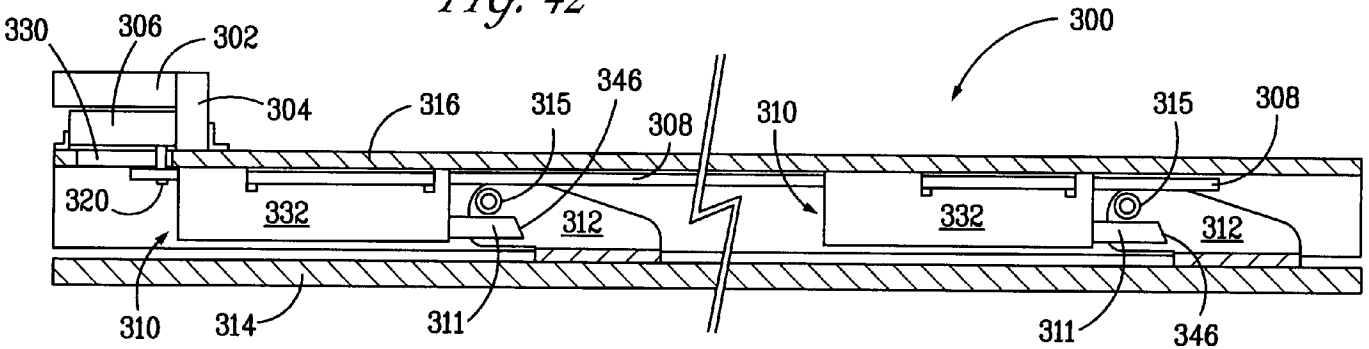
FIG. 42 is a cross sectional view showing the door of a cabinet equipped with the fourth embodiment of the latching system of the present invention in the closed position.
Figure 43:
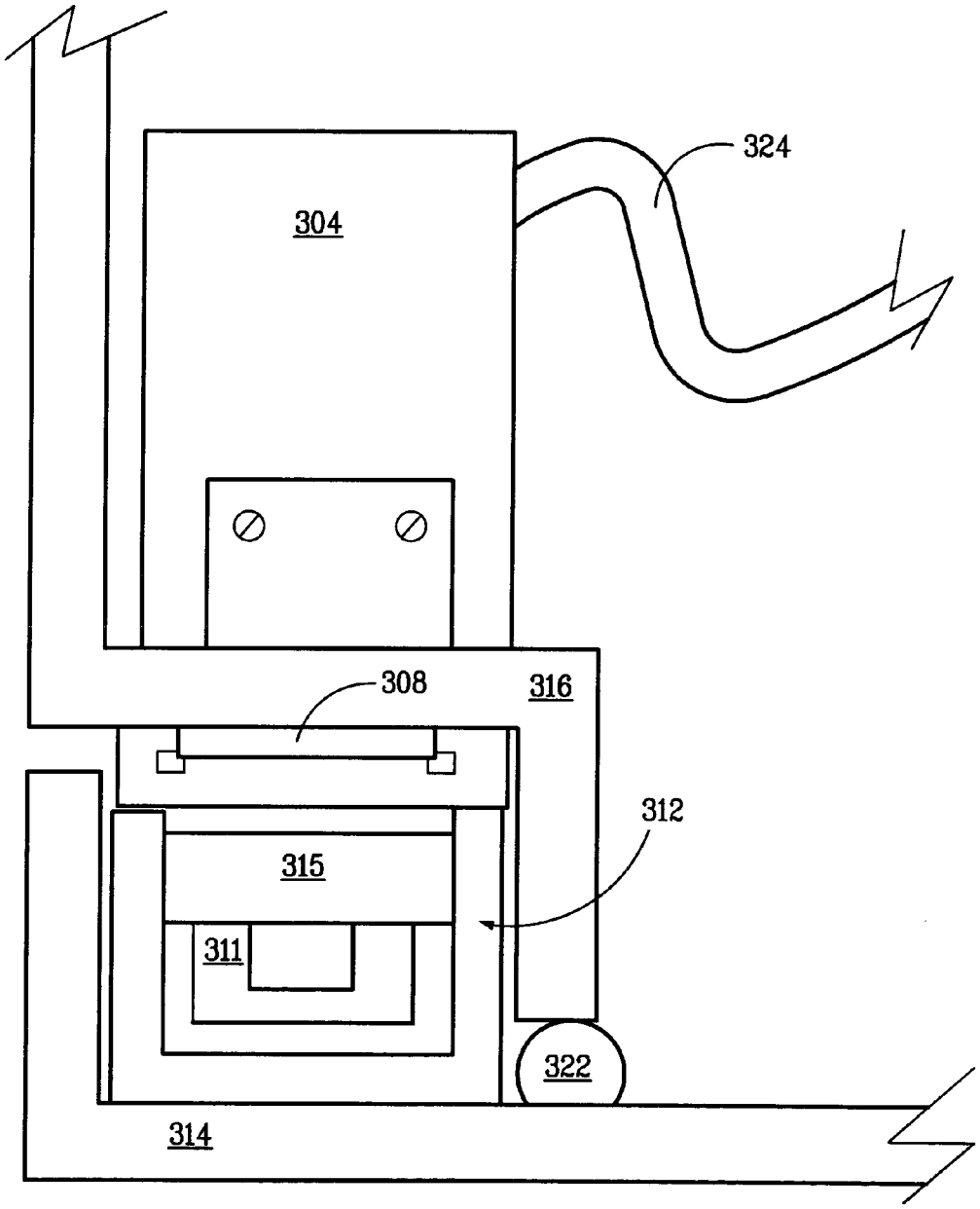
FIG. 43 is a cross sectional view from the top showing the door of a cabinet equipped with the fourth embodiment of the latching system of the present invention in the closed position.
Figure 44:
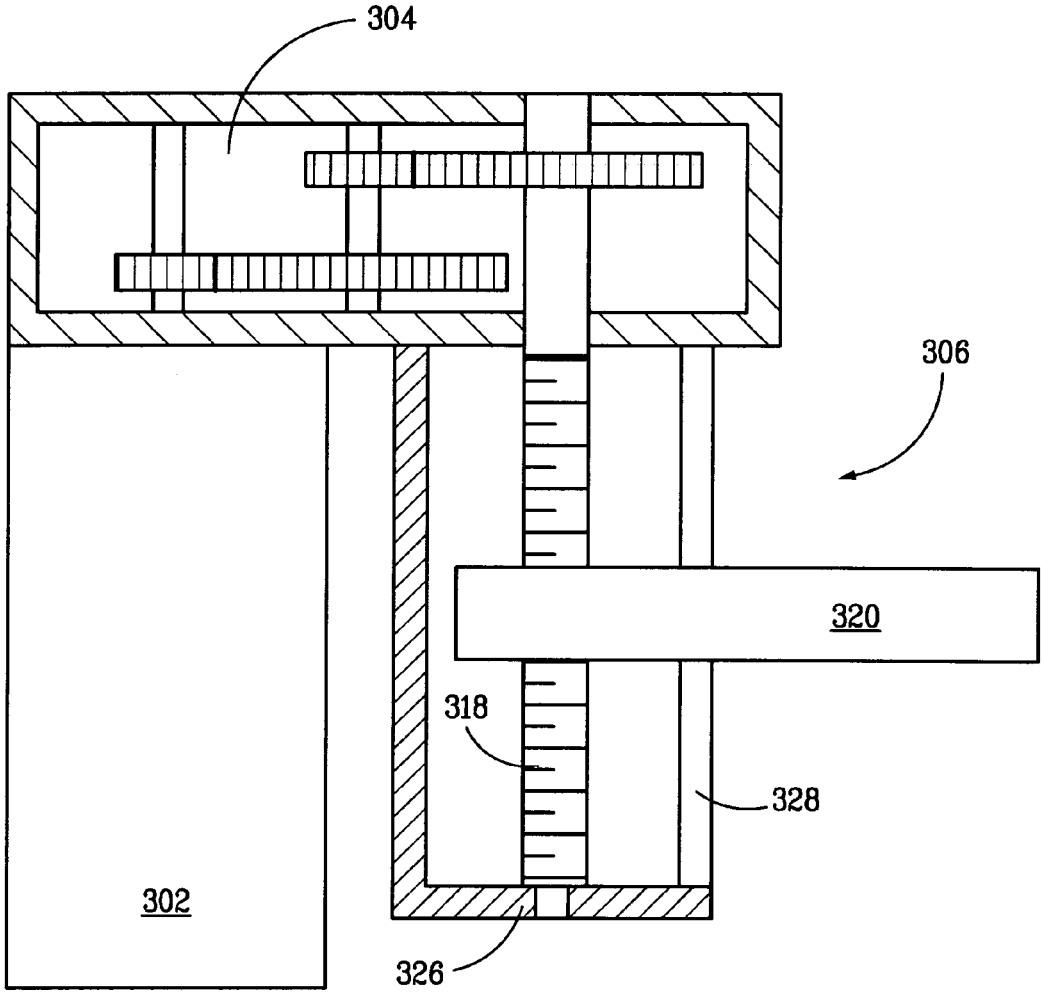
FIG. 44 is a cross sectional view showing internal details of the electromechanical actuating mechanism of the fourth embodiment of the latching system of the present invention.
Figure 45:
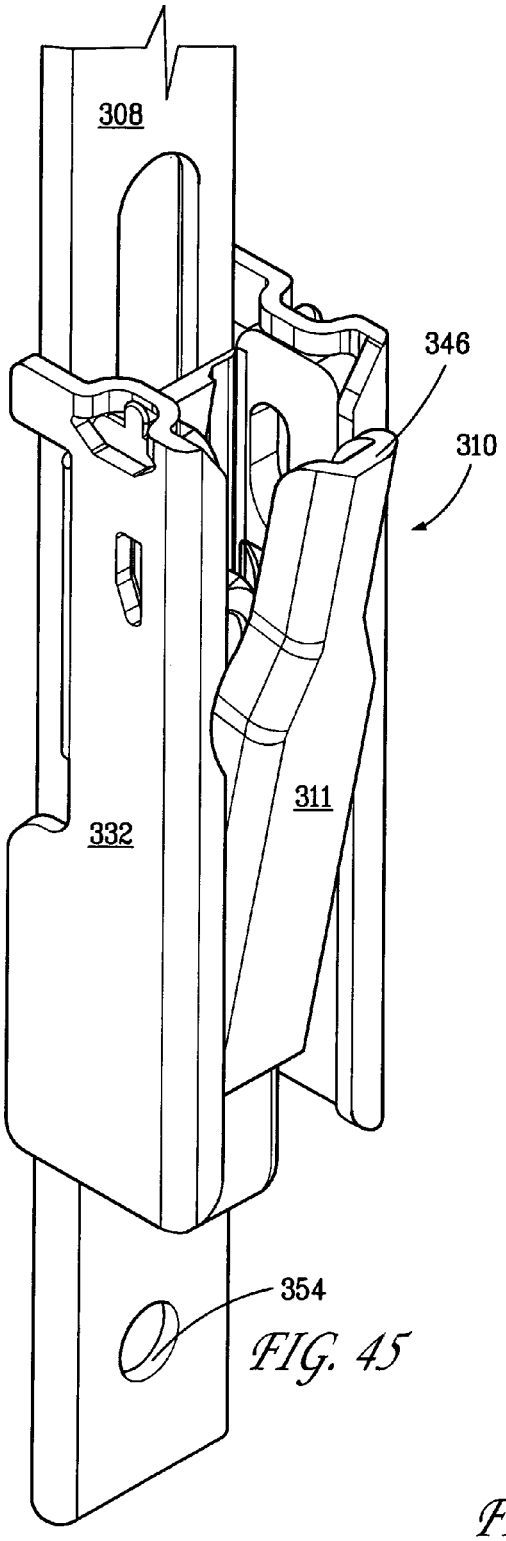
FIG. 45 is a perspective view showing the pawl mechanism of the fourth embodiment of the latching system of the present invention in the open configuration.
Figure 46:
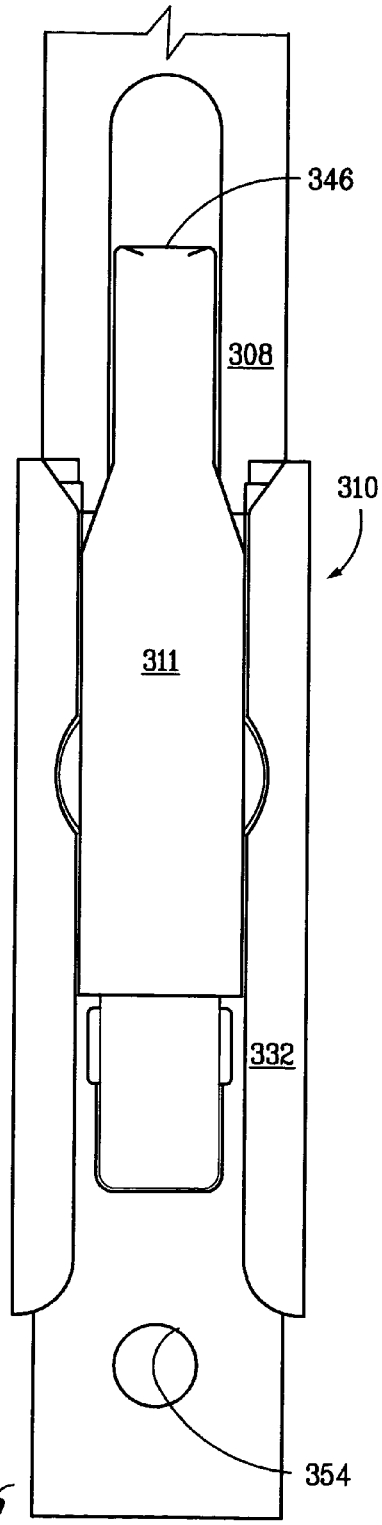
FIG. 46 is a plan view showing the pawl mechanism of the fourth embodiment of the latching system of the present invention in the closed configuration.
Figure 47:
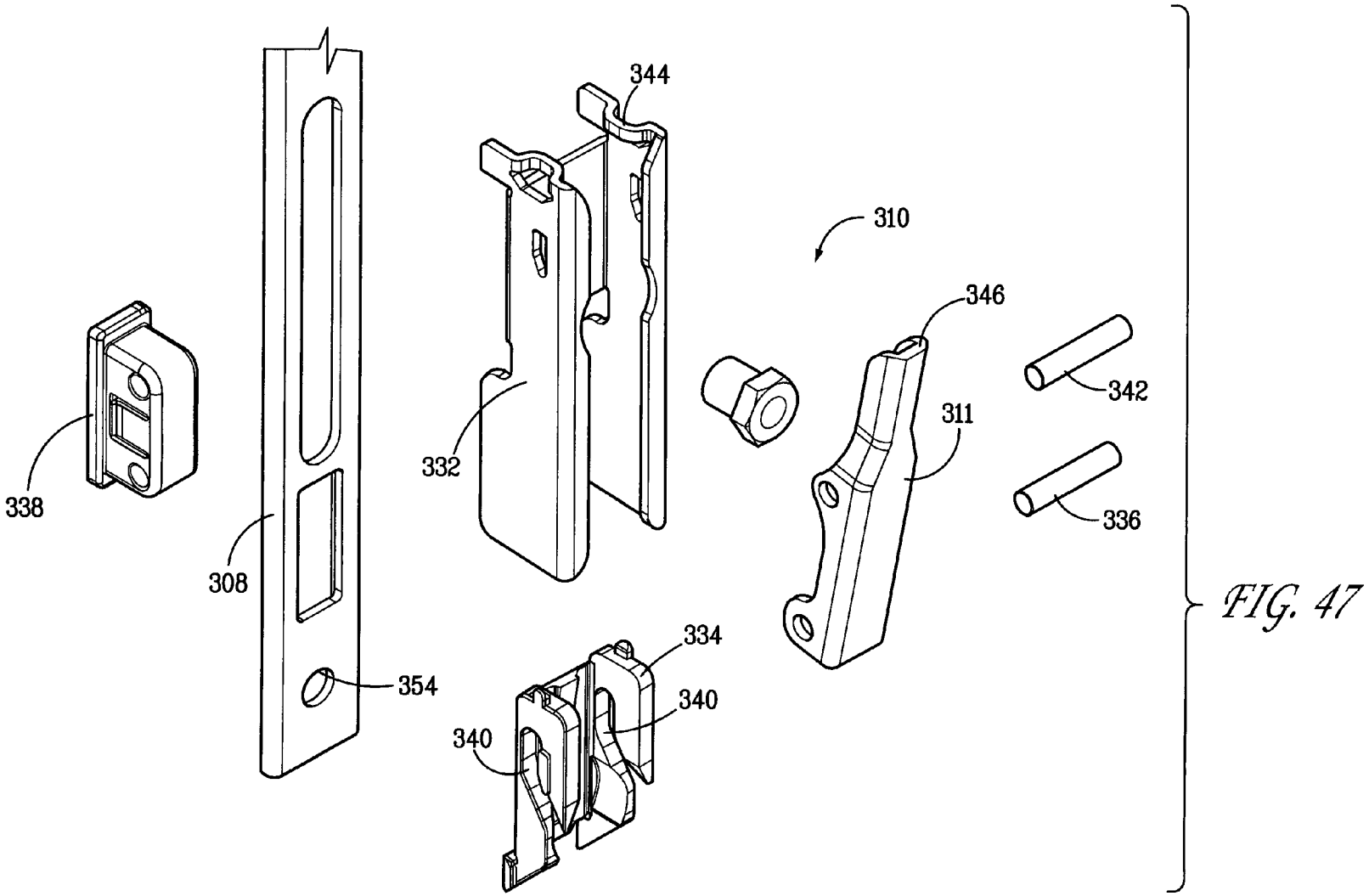
FIG. 47 is an exploded view of the pawl mechanism of the fourth embodiment of the latching system of the present invention.
Figure 48:
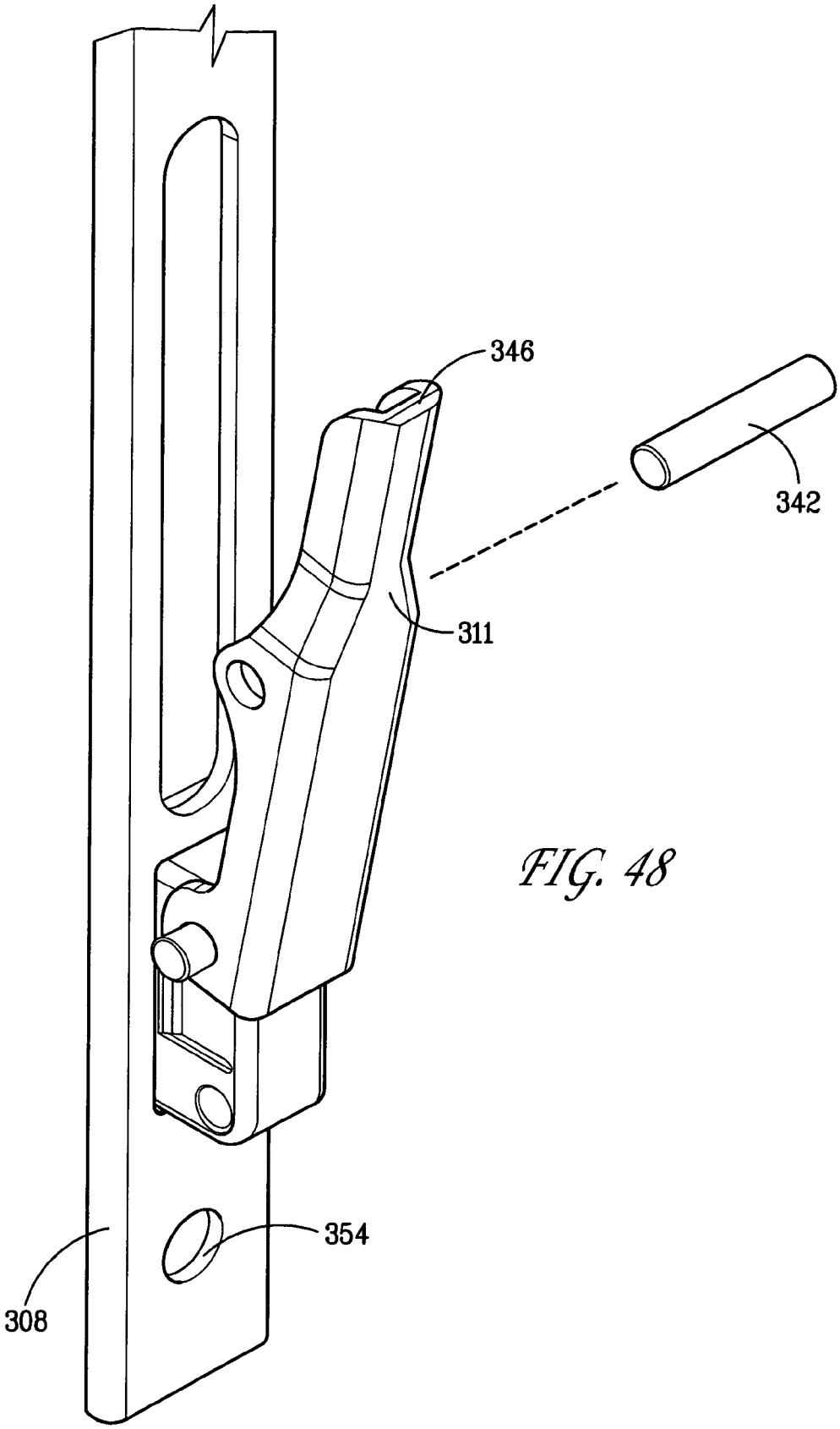
FIG. 48 is a partially exploded view showing the attachment of the pawl to the operating rod of the pawl mechanism of the fourth embodiment of the latching system of the present invention.
Figure 49:
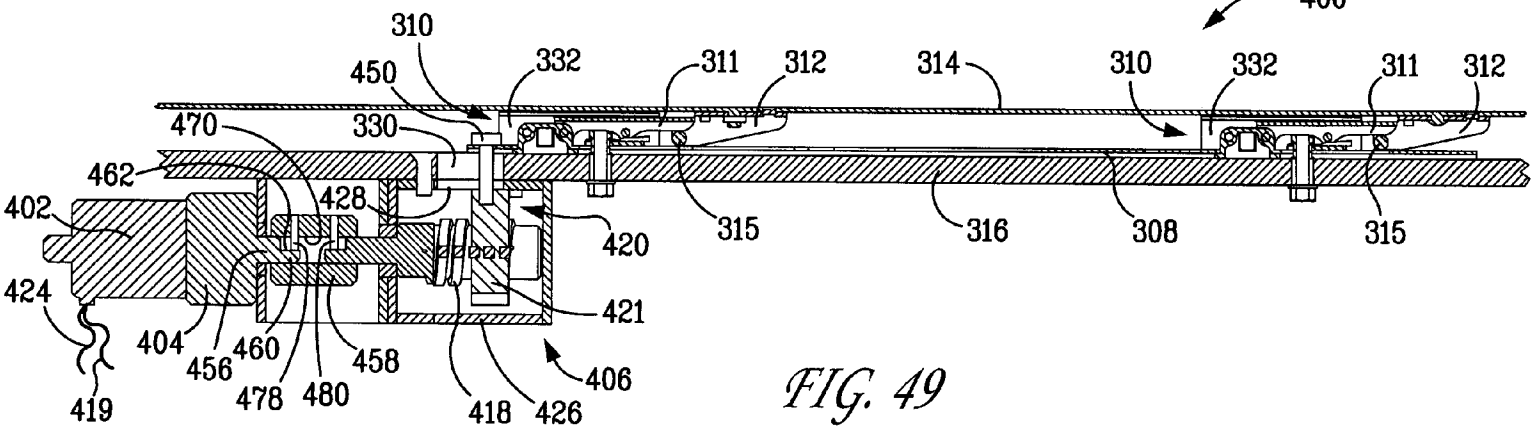
FIG. 49 is a cross sectional view showing the door of a cabinet equipped with a fifth embodiment of the latching system of the present invention in the closed position.
Figure 50:
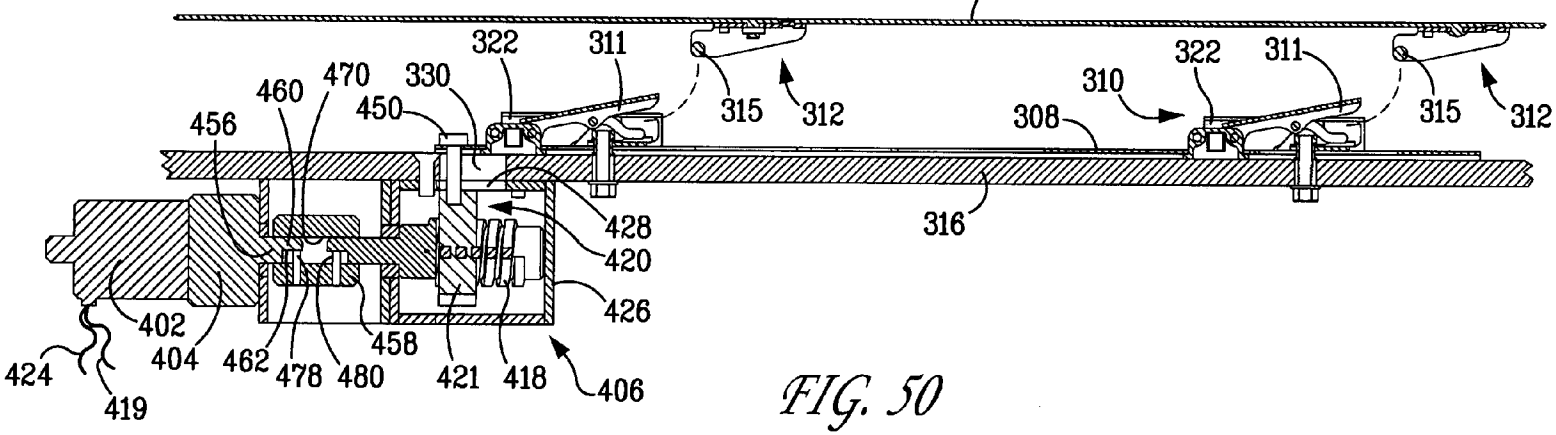
FIG. 50 is a cross sectional view showing the door of a cabinet equipped with a fifth embodiment of the latching system of the present invention in the open position.

In the open position (shown in FIGS. 36–40), the pawl 210 is situated at the end of the transverse portion 216 of the slot 214 that is distal from the longitudinal portion 218 of the slot 214. Note that the transverse slot portion 216 meets the longitudinal slot portion 218 near the end of the longitudinal slot portion that is nearest the gearbox 220, which is the opposite of the arrangement in the latch 100 wherein the transverse slot portion 116 meets the longitudinal slot portion 118 near the end of the longitudinal slot portion that is farthest from the gearbox 120. In the open position, the pawl is clear of the door. Rotation of the screw 208 moves the pawl 210 under the keeper 201 and into registry with the longitudinal portion 218 of the slot 214 where the longer longitudinal side or edge of the slot portion 218 prevents further rotation of the pawl 210. With the door closed and the pawl in this intermediate position (shown in FIGS. 31–35), the pawl is positioned under the keeper 201 such that the keeper will interfere with the pawl if opening the door is attempted. Then as the screw 208 continues to rotate, the pawl moves longitudinally, i.e. parallel to the longitudinal axis of the screw 208, until the pawl contacts the keeper 201 and pulls up the door 202 tightly against the doorframe 204 as shown in FIG. 26. Thus, latch 200 applies a compressive force between the door and the doorframe. This type of compressive force is useful in sealing the door 202 against the doorframe 204, especially when, for example a compressible gasket 203 is provided between the door and doorframe (see FIG. 26). To move the pawl 210 to the open position, the rotation of the screw 208 is reversed until the pawl is once again in the open position and the door can be opened. Reversing the rotation of the screw reverses the sequence of the movements of the pawl as described for the closing operation. Many of the mechanical aspects of the operation of the latch 200 are similar to the latch 100, except as previously noted.

The latch 200 also includes a gearbox 220 and motor 222. Motor shaft 224 is connected to the input end of the reducing speed (also known as increasing torque) gearbox 220. Latch screw 208 is connected to the output end of the gearbox 220. Main components of latch are housing 206, screw 208, female threaded pawl 210 that is essentially identical to the pawl 110 and four pins 226, 228, 230, and 232. The two pins 226 and 228 are attached to the either end of the threaded portion of the screw 208 inside the housing in such a way that the longitudinal axis of each pin is perpendicular to the longitudinal axis of the screw 208. The other two pins 230, 232 are attached to the pawl 210, one on each flat side. Here pins 230 and 232 are parallel to the longitudinal axis of the screw 208. The housing has an L-shaped slot 214 to guide the pawl travel.

Assume that latch is in released position (door open) and pawl is in the corner of the transverse slot portion 116 distal from the longitudinal slot portion 118 as shown in FIGS. 36–40. When the motor is energized, rotary motion of motor will be transferred to the screw 208 via gearbox 220. If this motion is in the proper direction, pawl will initially rotate until it contacts the longer edge of the longitudinal slot portion 218 and then starts traveling in the longitudinal slot portion 218 until the pawl pin 230 makes contact with the screw pin 226 located farthest from the gearbox 220. This will end the rotation of the screw 208 and thus the rotation of the gears and the motor. Motor will still remain energized until power to the motor gets turned off. When the rotation of the screw 208 is reversed, the pawl 210 will travel in the longitudinal slot portion 218 toward the transverse slot portion 216 until the pawl pin 232 makes contact with the screw pin 228 located nearest the gearbox 220. Once aligned with the transverse slot portion 216 the pin 228 makes contact with the pin 232 and the pawl and the screw 208 rotate together until the pawl is once again located in the corner of the transverse slot portion 216 distal from the longitudinal slot portion 218. At this point the rotation of the pawl is stopped by the closed end of the transverse slot portion 216 and the pawl acting through the contact between the pins 228 and 232 would stop the rotation of the gears as well as the rotation of the motor shaft. Again the motor would have remained energized until the power gets turned off. To change the direction of rotation of the screw 208, power polarity has to be reversed. After reversing the polarity, if motor gets energized, the pawl will travel in the L-shaped slot 214 in the reverse of the sequence just described until once again the pins 226 and 230 make contact.

This arrangement provides a single point contact at either limit of the travel of the pawl 210 for stopping the rotation of the screw 208 and the movement of the pawl 210. By providing a single point contact for stopping the rotation of the screw 208 and the movement of the pawl 210, jamming of the pawl 210 at either limit of its travel is prevented without resorting to expensive feedback control systems to control the movement of the pawl 210.

Depending on the motor size this latch can generate substantial force. For demonstrated size of the latch 25 to 250 lbs force at the pawl contact point is easily attainable. Here door compression or release takes place only during energized condition. Energized time has to be minimized to prevent over-heating of the motor. As with the latch 100, the numeric keypad 134 may be used by a user to energize the motors 222 with the user selected polarity such that unauthorized access through the door is prevented.

In the illustrated embodiment, a protective cover 236 is provided that encloses the housing 206, motor 222, and the gearbox 220. The cover 236 also has an L-shaped slot 238 that provides clearance for the movement of the pawl 210. Either of the slots 214 and 238 can provide for the control of the motion of the pawl 210, provided the material of the cover 236 has enough wear resistance and toughness to meet the duty requirements of the latch 200.

Referring to FIGS. 41–48, yet another embodiment of the locking or latching system that is actuated by a motor according to the present invention can be seen. The motor actuated latching system 300 is an example of the locking or latching system of the present invention. The latching system 300 includes a motor 302, a gearbox 304, an actuating mechanism 306, operating rod 308, pawl assemblies 310, and keepers 312. The keepers 312 are attached to the door 314. The motor 302, the gearbox 304, and the actuating mechanism 306 are supported by the doorframe or cabinet 316. The actuating mechanism 306 includes a screw 318 and an actuating arm 320. The actuating arm 320 is threadably engaged to the screw 318 such that the actuating arm 320 moves along the length of the screw 318 as the screw 318 rotates. The operating rod 308 moves slidably between retracted and extended positions relative to the cabinet 316. The operating rod 308 moves to its extended position shown in FIG. 42 as rotation of the screw 318 in a first direction moves the actuating arm 320 toward the pawl assemblies or pawl mechanisms 310. The operating rod 308 moves to its retracted position shown in FIG. 41 as rotation of the screw 318, in a second direction opposite the first direction, moves the actuating arm 320 away from the pawl assemblies or pawl mechanisms 310.

The operating rod 308 is operationally linked to at least one pawl assembly 310. The pawl assemblies 310 are supported by the cabinet or doorframe 316. With the operating rod 308 in the retracted position, the pawl 311 of each pawl assembly 310 is in the open position shown in FIGS. 41 and 45. With the door 314 closed as the motor 302 moves the actuating arm 320 to the extended position illustrated in FIG. 42, the operating rod 308 moves to its extended position, which in turn causes the pawl 311 of each pawl assembly 310 to move to the closed position shown in FIGS. 42, 43, and 46. As each pawl 311 moves to the closed position, each pawl 311 moves behind the roller 315 of the corresponding keeper 312 and pivots toward the doorframe 316. In doing so, the pawls 311 pull the door 314 up against the doorframe 316 and provide a compressive force between the door 314 and the doorframe 316, for example, so as to compress a sealing gasket 322. The door 314 is now secured in the closed or locked position.

As the polarity of the current supplied to the motor 302 is reversed, the motor 302 causes the screw 318 to rotate in a direction opposite to the direction of rotation of the screw during the locking operation described above. As the screw 318 rotates in this reverse direction, the actuating arm 320 and consequently the operating rod 308 move to the retracted position. As the operating rod 308 moves to the retracted position, the pawls 311 once again move to their open positions illustrated in FIGS. 41 and 45 and the door 314 can be opened.

The pawl assemblies 310 are known and will only be described briefly herein. The actuating mechanism 306 includes a housing 326 that supports the threaded shaft or screw 318 such that the screw 318 can rotate about its own longitudinal axis. The actuating mechanism 306 also has an actuating arm 320 that is supported by the screw 318. The arm 320 has a threaded hole that is engaged by the threads of the screw 318 such that when the arm 320 is prevented from rotation, the rotation of the screw 318 will move the arm 320 in the direction of the longitudinal axis of the screw 318. The arm 320 is adapted to engage the operating rod 308, for example, by being positioned to extend through a hole in the operating rod 308 such that the operating rod 308 will move in response to the movement of the actuating arm 320. The actuating arm 320 extends to the exterior of the housing 326 through an elongated slot 328 in the housing wall. Either the slot 328 or the slot 330 in the doorframe 316 can serve to prevent rotation of the actuating arm 320 so that the actuating arm 320 moves along the longitudinal axis of the screw 318 as the screw 318 rotates. The motor 302 drives the screw 318 via the gearbox 304. The gearbox 304 is preferably of the reducing speed (also known as increasing torque) type so as to allow the use of a smaller and lighter motor operating at higher speed.

Each pawl assembly 310 includes rod guide shell 332, a rod guide insert 334 and a pawl 311. The pawl 311 is pivotally attached to the operating rod 308 such that the pawl 311 translates with the operating rod 308 while being capable of moving pivotally relative to the operating rod 308. In the illustrated example, the pawl 311 is pivotally attached to the operating rod 308 by placing a cylindrical pin 336 through holes in the pawl 311 that are in registry with a hole in a pillow block 338 that is attached to the operating rod 308. The rod guide insert 334 is secured in place inside the rod guide shell 332 and provides at least one cam track 340. In the illustrated embodiment a pair of opposing cam tracks 340 are provided to more evenly distribute the loads applied to the pawl 311 while the door 314 is held in the closed position and during compression of the gasket 322. As an alternative, the cam tracks 340 may be provided integrally with the rod guide shell 332. A cam follower pin 342 passes through the pawl 311 and rides along the cam tracks 340. The rod guide shell 332 is attached to the doorframe 316 and helps to guide the operating rod 308 in its sliding movement. The cam tracks 340 are sloped so that they run closer to the base of the rod guide shell 332 with decreasing distance from the forward end 344 of the rod guide shell. The base of the rod guide shell 332 is that portion of the rod guide shell 332 that is adjacent the doorframe 316. With this arrangement of the cam tracks 340, as the pawl 311 moves up behind the roller 315 of the keeper 312 the cam tracks 340 cooperate with the cam follower pin 342 to draw the tip 346 of the pawl 311 toward the doorframe 316 and thus provide a compressive force between the door 314 and the doorframe 316 in the closed configuration.

A numeric keypad (not shown) may use to prevent unauthorized access through the door 314. By entering the proper combination using the numeric keypad, a user can cause electric power to be supplied to the motor 302 via power cable 324 with a polarity which moves the operating rod 308 to the retracted position, thus allowing the door 314 to be opened. By shutting the door 314 and entering a proper command via the keypad, the polarity of the current supply to the motor 302 is reversed to thereby effect locking of the door 314.

Referring to FIGS. 49–60, a fifth embodiment 400 of a motor actuated latching system according to the present invention can be seen. The latching system 400 differs from the latching system 300 mainly in the arrangement of the motor, gearbox, and screw, in the structure of the coupling between the gearbox and the screw, and in the structural details of the actuating arm that moves along the length of the screw as the screw rotates.

The latching system 400 includes a motor 402, a gearbox 404, an actuating mechanism 406, operating rod 308, pawl assemblies 310, and keepers 312. The keepers 312 are attached to the door 314. The motor 402, the gearbox 404, and the actuating mechanism 406 are supported by the doorframe or cabinet 316. With both latching systems 300 and 400 it is possible to reverse the positions of the keepers and of the motor, gearbox, and actuating mechanism. In other words, it is possible to install the motor, gearbox, and actuating mechanism on the door and to install the keepers on the doorframe or cabinet. The actuating mechanism 406 includes a threaded rod or screw 418 and an actuating arm 420. The actuating arm 420 includes a nut 421 that has a threaded central opening 423 and is threadably engaged to the screw 418 such that the nut 421 moves along the length of the screw 418 as the screw 418 rotates. The nut 421 also has a lateral projection or boss 425 that is provided with a threaded hole 427. The actuating arm 420 also includes a bolt or screw 450 that has a threaded shaft 452 that is threadably engaged to the threaded hole 427. With this arrangement, the actuating arm 420 as a whole moves along the length of the screw 418 as the screw 418 rotates. The bolt 450 acts to engage the operating rod 308 as is described herein below. The operating rod 308 moves slidably between retracted and extended positions relative to the cabinet 316. The operating rod 308 moves to its extended position shown in FIG. 49 as rotation of the screw 418 in a first direction moves the actuating arm 420 toward the pawl assemblies or pawl mechanisms 310. The operating rod 308 moves to its retracted position shown in FIG. 50 as rotation of the screw 418, in a second direction opposite the first direction, moves the actuating arm 420 away from the pawl assemblies or pawl mechanisms 310.

The operating rod 308 is operationally linked to at least one pawl assembly 310. The pawl assemblies 310 are supported by the cabinet or doorframe 316. With the operating rod 308 in the retracted position, the pawl 311 of each pawl assembly 310 is in the open position shown in FIGS. 50 and 45. With the door 314 closed, as the motor 402 moves the actuating arm 420 to the extended position illustrated in FIG. 49, the operating rod 308 moves to its extended position, which in turn causes the pawl 311 of each pawl assembly 310 to move to the closed position shown in FIGS. 49 and 46. As each pawl 311 moves to the closed position, each pawl 311 moves behind the roller 315 of the corresponding keeper 312 and pivots toward the doorframe 316. In doing so, the pawls 311 pull the door 314 up against the doorframe 316 and provide a compressive force between the door 314 and the doorframe 316, for example, so as to compress a sealing gasket 322. The door 314 is now secured in the closed or locked position.

As the polarity of the current supplied to the motor 402 is reversed, the motor 402 causes the screw 418 to rotate in a direction opposite to the direction of rotation of the screw during the locking operation described above. As the screw 418 rotates in this reverse direction, the actuating arm 420 and consequently the operating rod 308 move to the retracted position. As the operating rod 308 moves to the retracted position, the pawls 311 once again move to their open positions illustrated in FIGS. 50 and 45 and the door 314 can be opened.

The pawl assemblies 310 are known and will only be described briefly herein. The actuating mechanism 406 includes a housing 426 that supports the threaded shaft or screw 418 such that the screw 418 can rotate about its own longitudinal axis. The actuating mechanism 406 also has an actuating arm 420. The actuating arm 420 includes a nut 421 and a bolt or screw 450. The nut 421 that has a threaded central opening 423 and is threadably engaged to the screw 418 such that the nut 421 moves along the length of the screw 418 as the screw 418 rotates. The nut 421 also has a lateral projection or boss 425 that is provided with a threaded hole 427. The bolt or screw 450 has a threaded shaft 452 that is threadably engaged to the threaded hole 427. With this arrangement, the actuating arm 420 as a whole moves along the length of the screw 418, i.e. in the direction of the longitudinal axis of the screw 418, as the screw 418 rotates when the arm 420 itself is prevented from rotation. Thus, the actuating arm 420 can be considered as having a threaded hole that is engaged by the threads of the screw 418 such that when the arm 420 is prevented from rotation, the rotation of the screw 418 will move the arm 420 in the direction of the longitudinal axis of the screw 418.

The arm 420 is adapted to engage the operating rod 308. In the illustrated example, the bolt 450 engages the operating rod 308 by being positioned to extend through a hole 354 in the operating rod 308 such that the operating rod 308 will move in response to the movement of the actuating arm 420. The operating rod 308 will move linearly together with the actuating arm 420, in a direction parallel to the longitudinal axis of the screw 418, as the actuating arm 420 moves along the length of the screw 418. The actuating arm 420 extends to the exterior of the housing 426 through an elongated slot 428 in the housing wall. More specifically, in the illustrated example it is the bolt 450 that extends to the exterior of the housing 426 through the elongated slot 428. Either the slot 428 or the slot 330 in the doorframe 316 can serve to prevent rotation of the actuating arm 420 so that the actuating arm 420 moves along the longitudinal axis of the screw 418 as the screw 418 rotates. The motor 402 drives the screw 418 via the gearbox 404. The gearbox 404 is preferably of the reducing speed (also known as increasing torque) type so as to allow the use of a smaller and lighter motor operating at higher speed.

In the illustrated example of FIGS. 49–56, the screw 418 is coupled to the output shaft 456 of the gearbox 404 using the cylindrical sleeve 458. The output shaft 456 has an end portion 460 that has a semicircular cross section so as to define a flat surface 462. Similarly, the screw 418 has an end portion 464 that has a semicircular cross section so as to define a flat surface 466. The other end 468 of the screw 418 is supported for rotational movement by the housing 426. The cylindrical sleeve 458 has a longitudinal bore 470 that extends through the length of the cylindrical sleeve 458 in a coaxial manner with the longitudinal axis of the cylindrical sleeve 458. Two threaded bores 472 and 474 extend from the outer surface 476 of the cylindrical sleeve 458 to the bore 470. The threaded bores 472 and 474 extend in a direction perpendicular to the longitudinal axis of the cylindrical sleeve 458 and are positioned apart from one another along the length of the cylindrical sleeve 458. Each of the threaded bores 472 and 474 is provided with a set screw, 478 and 480 respectively, that engages the respective threaded bore 472 or 474. The end portion 460 of the output shaft 456 is received in the bore 470 of the cylindrical sleeve 458 through one end of the bore 470, and the end portion 464 of the screw 418 is received in the bore 470 of the cylindrical sleeve 458 through the other end of the bore 470. The end portion 460 of the output shaft 456 is positioned in the bore 470 such that the flat surface 462 registers with the threaded bore 472, and the end portion 464 of the screw 418 is positioned in the bore 470 such that the flat surface 466 registers with the threaded bore 474. The set screws 478 and 480 are then tightened to engage the flat surfaces 462 and 466, respectively, and thereby secure the end portions of the output shaft 456 and the screw 418 within the bore 470. This arrangement prevents any relative rotation between the end portions of the output shaft 456 and the screw 418 and the cylindrical sleeve 458 such that the screw 418 rotates with the output shaft 456. Thus, the screw 418 can be driven to rotate by the output shaft 456 of the gearbox 404.

It should be noted that alternative designs may be used for the end portions 460 and 464. For example, the end portions 460 and 464 may be provided with holes or bores that are engaged by the set screws 478 and 480. As a further alternative, the end portions 460 and 464 may be circular in cross section and with the set screws 478 and 480 frictionally engaging the end portions 460 and 464. As yet another alternative, the end portions 460 and 464 may have flat surfaces for engagement by the set screws 478 and 480, that are defined by chords smaller than the diameter of the circle partly defining the perimeter of the cross sections of the end portions 460 and 464.

Figure 51:
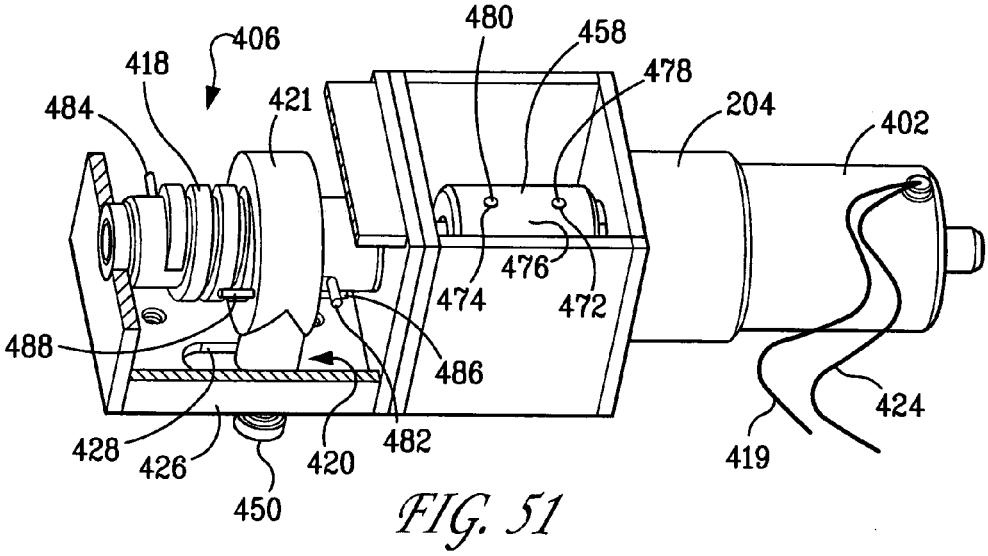
FIG. 51 is a fragmentary perspective view of the motor drive and screw of the fifth embodiment of the latching system of the present invention showing the actuating arm in the retracted or open position.
Figure 52:
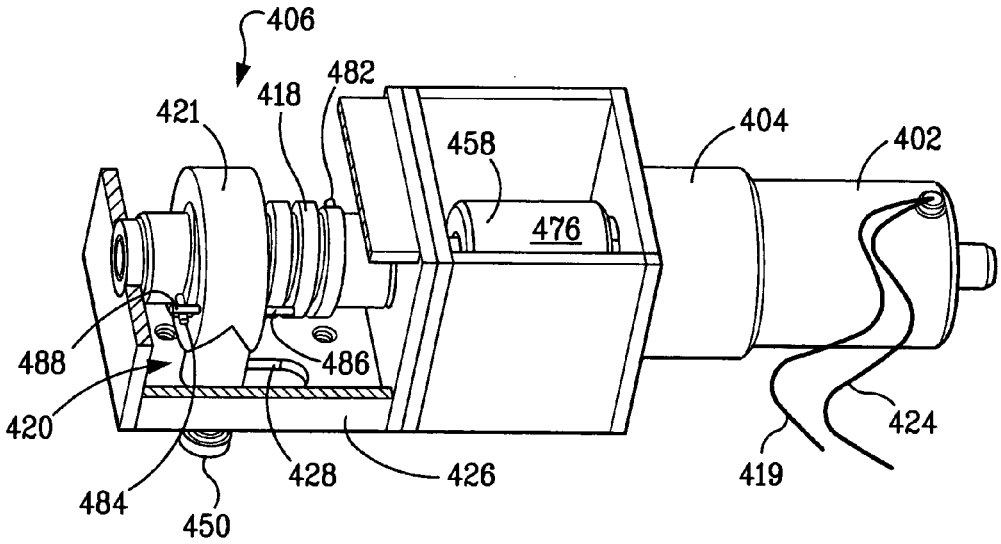
FIG. 52 is a fragmentary perspective view of the motor drive and screw of the fifth embodiment of the latching system of the present invention showing the actuating arm in the extended or closed position.
Figure 53:
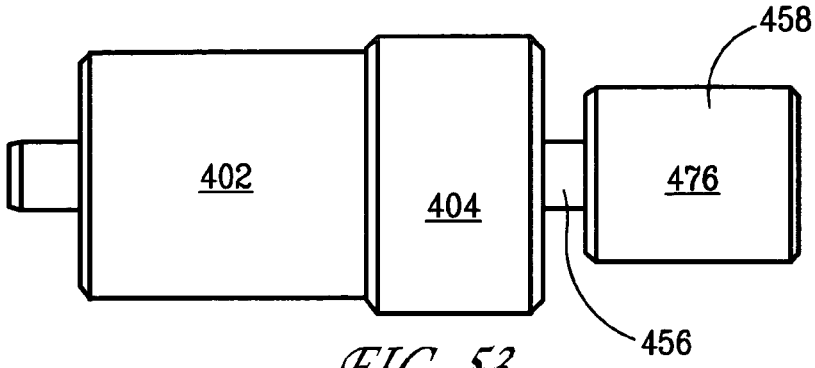
FIG. 53 is a view of the motor drive of the fifth embodiment of the latching system of the present invention shown in isolation.
Figure 54:
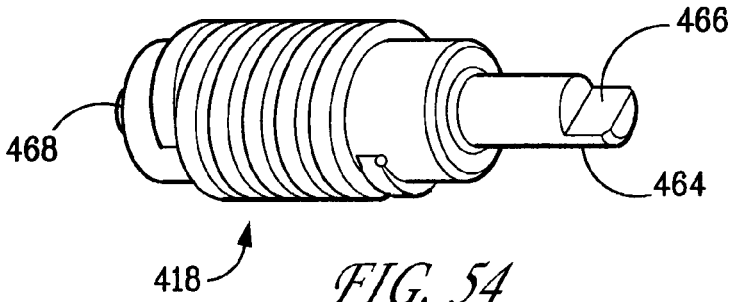
FIGS. 54–56 are views of the threaded rod or screw that drives the actuating arm for use with the fifth embodiment of the latching system of the present invention.
Figure 55:
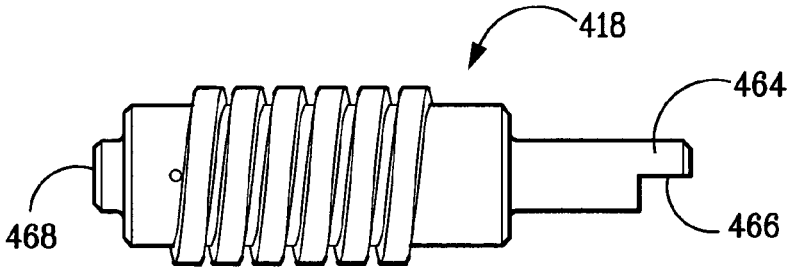
Figure 56:
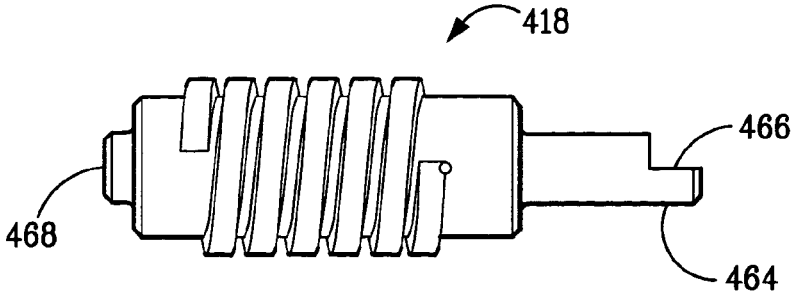
Figure 57:
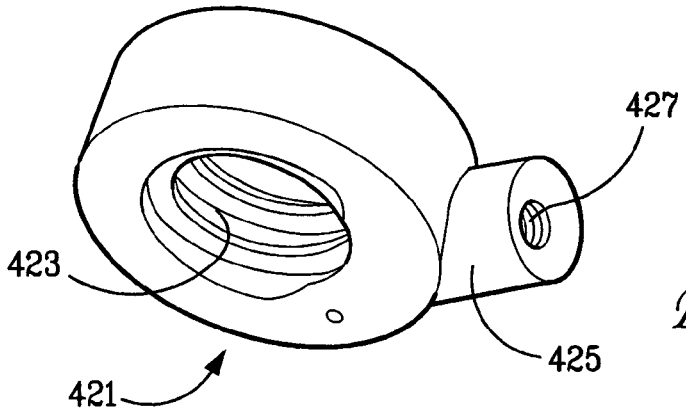
FIGS. 57–58 are views of the threaded nut of the actuating arm for use with the fifth embodiment of the latching system of the present invention.
Figure 58:
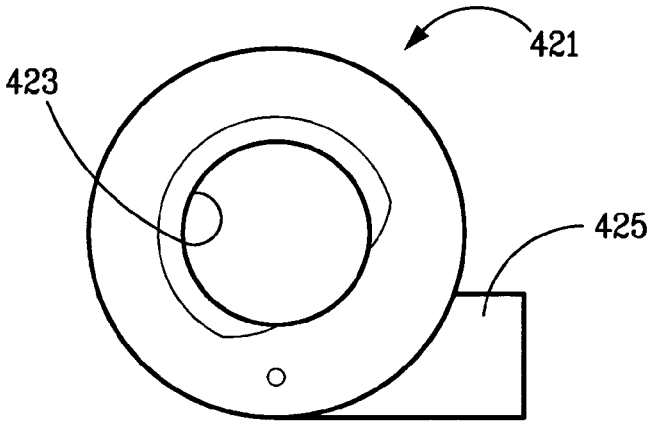
Figure 59:
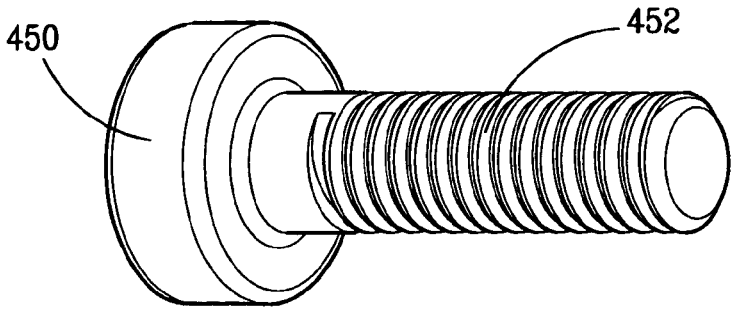
FIG. 59 is a perspective view of the bolt that forms part of the actuating arm for use with the fifth embodiment of the latching system of the present invention.
Figure 60:
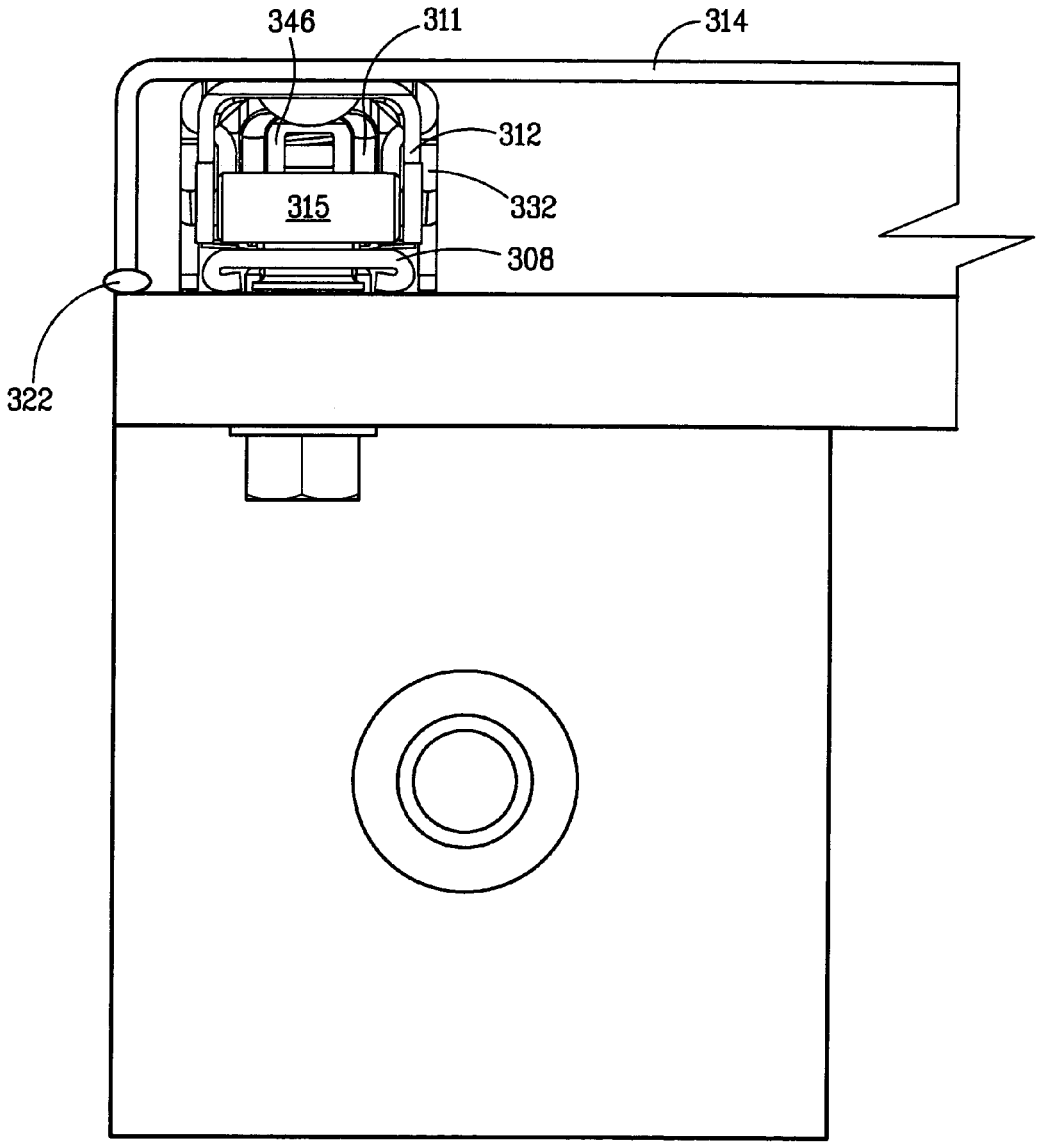
FIG. 60 is an end view of the fifth embodiment of the latching system of the present invention showing the pawl assembly or pawl mechanism of the present invention in the latched position and engaged to a keeper.

The latching systems 300 and 400 also include four pins 482, 484, 486, and 488. Two pins 482 and 484 are attached to the screw 318 or 418 near either end of the threaded portion of the screw 318 or 418. The longitudinal axis of each of the pins 482 and 484 is perpendicular to the longitudinal axis of the screw 318 or 418. The other two pins 486, 488 are attached to the actuating arm 320 or 420 and project from opposite sides of the actuating arm 320 or 420 in a direction parallel to the longitudinal axis of the screw 318 or 418. The pins 482, 484, 486, and 488 act to stop the movement of the actuating arm 320 or 420 at either limit of the travel of the actuating arm 320 or 420. As illustrated in FIG. 51, pin 486 contacts the pin 482 to stop the rotation of the screw 418 and the further movement of the actuating arm 420 when the actuating arm 420 reaches the fully retracted or open position. As illustrated in FIG. 52, pin 488 contacts the pin 484 to stop the rotation of the screw 418 and the further movement of the actuating arm 420 when the actuating arm 420 reaches the fully extended or closed position. Because the pins 486 and 488 are perpendicular to the pins 482 and 484, these pins provide a single point contact at either limit of the travel of the actuating arm 420 for stopping the rotation of the screw 418 and the movement of the actuating arm 420. By providing a single point contact for stopping the rotation of the screw 418 and the movement of the actuating arm 420, jamming of the actuating arm 420 at either limit of its travel is prevented without resorting to expensive feedback control systems to control the movement of the actuating arm 420.

Each pawl assembly 310 includes rod guide shell 332, a rod guide insert 334 and a pawl 311. The pawl 311 is pivotally attached to the operating rod 308 such that the pawl 311 translates with the operating rod 308 while being capable of moving pivotally relative to the operating rod 308. In the illustrated example, the pawl 311 is pivotally attached to the operating rod 308 by placing a cylindrical pin 336 through holes in the pawl 311 that are in registry with a hole in a pillow block 338 that is attached to the operating rod 308. The rod guide insert 334 is secured in place inside the rod guide shell 332 and provides at least one cam track 340. In the illustrated embodiment, a pair of opposing cam tracks 340 are provided to more evenly distribute the loads applied to the pawl 311 while the door 314 is held in the closed position and during compression of the gasket 322. As an alternative, the cam tracks 340 may be provided integrally with the rod guide shell 332. A cam follower pin 342 passes through the pawl 311 and rides along the cam tracks 340. The rod guide shell 332 is attached to the doorframe 316 and helps to guide the operating rod 308 in its sliding movement. The cam tracks 340 are sloped so that they run closer to the base of the rod guide shell 332 with decreasing distance from the forward end 344 of the rod guide shell. The base of the rod guide shell 332 is that portion of the rod guide shell 332 that is adjacent the doorframe 316. With this arrangement of the cam tracks 340, as the pawl 311 moves up behind the roller 315 of the keeper 312 the cam tracks 340 cooperate with the cam follower pin 342 to draw the tip 346 of the pawl 311 toward the doorframe 316 and thus provide a compressive force between the door 314 and the doorframe 316 in the closed configuration.

A numeric keypad (not shown) may use to prevent unauthorized access through the door 314. By entering the proper combination using the numeric keypad, a user can cause electric power to be supplied to the motor 402 via wires 424 and 419 with a polarity which moves the operating rod 308 to the retracted position, thus allowing the door 314 to be opened. By shutting the door 314 and entering a proper command via the keypad, the polarity of the current supply to the motor 402 is reversed to thereby effect locking of the door 314.

It is to be understood that the present invention is not limited to the embodiments disclosed above, but includes any and all embodiments within the scope of the appended claims.

What is claimed is:

1. A screw drive mechanism comprising:

a housing defining a first edge, said housing being adapted for mounting to a first closure member that is movable relative to a second closure member;

a screw comprising a threaded portion formed by a threaded shaft having a screw thread, said screw having a longitudinal axis and being supported for rotational movement by said housing;

a member having a threaded hole and being supported by said screw such that at least a portion of said screw thread is in engagement with said threaded hole, said member having said threaded hole being a pawl;

a first pin projecting from said screw perpendicularly relative to said longitudinal axis of said screw;

a second pin projecting from said screw perpendicularly relative to said longitudinal axis of said screw, said second pin being spaced apart from said first pin such that at least a portion of said screw thread is positioned intermediate said first pin and said second pin, said member having said threaded hole being positioned intermediate said first pin and said second pin;

a third pin projecting from said member having said threaded hole in a direction parallel to said longitudinal axis of said screw;

a fourth pin projecting from said member having said threaded hole in a direction opposite to said third pin and parallel to said longitudinal axis of said screw; and a motor drive coupled to said screw, said motor drive selectively rotating said screw about said longitudinal axis of said screw in a first direction, and said motor drive selectively rotating said screw about said longitudinal axis of said screw in a second direction opposite to said first direction, wherein said member having said threaded hole is adapted to move along said screw in a direction parallel to said longitudinal axis of said screw responsive to rotation of said screw in at least one of said first direction and said second direction, movement of said member having said threaded hole along said screw in a direction parallel to said longitudinal axis of said screw defining a range of linear longitudinal movement of said member having said threaded hole, wherein said first pin contacts said third pin to stop rotation of said screw relative to said member having said threaded hole at a first limit of said range of linear longitudinal movement of said member having said threaded hole when said screw has been rotating in said first direction relative to said housing, wherein said second pin contacts said fourth pin to stop rotation of said screw relative to said member having said threaded hole at a second limit of said range of linear longitudinal movement of said member having said threaded hole when said screw has been rotating in said second direction relative to said housing, wherein with said member having said threaded hole positioned proximate said second limit of said range of linear longitudinal movement of said member having said threaded hole and with said member having said threaded hole being in contact with said first edge, rotation of said screw in said first direction relative to said housing moves said member having said threaded hole along said longitudinal axis of said screw toward said first limit of said range of linear longitudinal movement of said member having said threaded hole, wherein with said member having said threaded hole positioned proximate said second limit of said range of linear longitudinal movement of said member having said threaded hole and with said member having said threaded hole being out of contact with said first edge and with said member having said threaded hole positioned such that the first closure member can be freely opened relative to the second closure member, rotation of said screw in said first direction relative to said housing rotationally moves said member having said threaded hole until said member having said threaded hole contacts said first edge and said member having said threaded hole is positioned such that it is superimposed over a portion of the second closure member, and wherein continued rotation of said screw in said first direction relative to said housing moves said member having said threaded hole along said longitudinal axis of said screw toward said first limit of said range of linear longitudinal movement of said member having said threaded hole to thereby secure the first closure member in a closed position relative to the second closure member and generate a compressive force between the first closure member and the second closure member.

2. The screw drive mechanism of claim 1, wherein with said member having said threaded hole positioned proximate said second limit of said range of linear longitudinal movement of said member having said threaded hole and with said member having said threaded hole positioned such that it is superimposed over a portion of the second closure member, rotation of said screw in said second direction rotationally moves said member having said threaded hole until said member having said threaded hole is positioned such that the first closure member can be freely opened relative to the second closure member.

3. The screw drive mechanism of claim 2, wherein said housing further defines a second edge, wherein with said member having said threaded hole positioned proximate said first limit of said range of linear longitudinal movement of said member having said threaded hole and with said member having said threaded hole being in contact with said second edge, rotation of said screw in said second direction relative to said housing moves said member having said threaded hole along said longitudinal axis of said screw toward said second limit of said range of linear longitudinal movement of said member having said threaded hole.

4. The screw drive mechanism of claim 1, wherein said housing further defines a second edge, wherein with said member having said threaded hole positioned proximate said first limit of said range of linear longitudinal movement of said member having said threaded hole and with said member having said threaded hole being in contact with said second edge, rotation of said screw in said second direction relative to said housing moves said member having said threaded hole along said longitudinal axis of said screw toward said second limit of said range of linear longitudinal movement of said member having said threaded hole.

5. The screw drive mechanism of claim 1, wherein said housing is adapted for mounting to a first closure member that cooperates with a second closure member, the second closure member is movable relative to the first closure member, wherein said member having said threaded hole is a pawl, and wherein with said member having said threaded hole positioned proximate said second limit of said range of linear longitudinal movement of said member having said threaded hole and with said member having said threaded hole positioned such that said member having said threaded hole cannot interfere with the second closure member, rotation of said screw in said first direction relative to said housing rotationally moves said member having said threaded hole until said member having said threaded hole is positioned such that it can interfere with the second closure member if movement of the second closure member relative to the first closure member is attempted, and wherein continued rotation of said screw in said first direction relative to said housing moves said member having said threaded hole along said longitudinal axis of said screw toward said first limit of said range of linear longitudinal movement of said member having said threaded hole to thereby secure the second closure member in a closed position relative to the first closure member and generate a compressive force between the second closure member and the first closure member.

6. The screw drive mechanism of claim 5, wherein with said member having said threaded hole positioned proximate said second limit of said range of linear longitudinal movement of said member having said threaded hole and with said member having said threaded hole positioned such that it can interfere with the second closure member if movement of the second closure member relative to the first closure member is attempted, rotation of said screw in said second direction rotationally moves said member having said threaded hole until said member having said threaded hole is positioned such that said member having said threaded hole can no longer interfere with the second closure member and the second closure member can be freely opened relative to the first closure member.

7. The screw drive mechanism of claim 1, wherein said housing is adapted for mounting to a first closure member that cooperates with a second closure member, the second closure member is movable relative to the first closure member, wherein said member having said threaded hole is an actuating arm, and wherein the screw drive mechanism is part of an electromechanical latching system that further comprises:

an operating rod engaged by said actuating arm; and at least one pawl assembly including a pawl movable between a latched position and an unlatched position, said operating rod operating said at least one pawl assembly to move said pawl between said latched position and said unlatched position as said operating rod is moved linearly in response to linear movement of said actuating arm along said longitudinal axis of said screw, wherein with said actuating arm positioned proximate said second limit of said range of linear longitudinal movement, rotation of said screw in said first direction relative to said housing moves said actuating arm along said longitudinal axis of said screw toward said first limit of said range of linear longitudinal movement to thereby place said at least one pawl assembly in said latched position and secure the second closure member in a closed position relative to the first closure member, and wherein with said actuating arm positioned proximate said first limit of said range of linear longitudinal movement, rotation of said screw in said second direction relative to said housing moves said actuating arm along said longitudinal axis of said screw toward said second limit of said range of linear longitudinal movement to thereby place said at least one pawl assembly in said unlatched position and release the second closure member from the closed position relative to the first closure member.

8. The screw drive mechanism of claim 7, wherein said motor drive comprises a motor and a gearbox.

9. The screw drive mechanism of claim 1, wherein said motor drive comprises a motor and a gearbox.

10. A screw drive mechanism comprising:

a housing, said housing defining a first edge;

a screw comprising a threaded portion formed by a threaded shaft having a screw thread, said screw having a longitudinal axis and being supported for rotational movement by said housing;

a member having a threaded hole and being supported by said screw such that at least a portion of said screw thread is in engagement with said threaded hole; and a motor drive coupled to said screw, said motor drive selectively rotating said screw about said longitudinal axis of said screw in a first direction, and said motor drive selectively rotating said screw about said longitudinal axis of said screw in a second direction opposite to said first direction, wherein said housing is adapted for mounting to a first closure member that is movable relative to a second closure member, wherein said member having said threaded hole is a pawl, wherein said member having said threaded hole is adapted to move along said screw in a direction parallel to said longitudinal axis of said screw responsive to rotation of said screw in at least one of said first direction and said second direction, movement of said member having said threaded hole along said screw in a direction parallel to said longitudinal axis of said screw defining a range of linear longitudinal movement of said member having said threaded hole, said range of linear longitudinal movement having a first limit and a second limit a distance apart from said first limit, and wherein said member having said threaded hole moves rotationally with said screw proximate one of said first limit and said second limit, wherein with said member having said threaded hole positioned proximate said second limit of said range of linear longitudinal movement of said member having said threaded hole and with said member having said threaded hole being in contact with said first edge, rotation of said screw in said first direction relative to said housing moves said member having said threaded hole along said longitudinal axis of said screw toward said first limit of said range of linear longitudinal movement of said member having said threaded hole, wherein with said member having said threaded hole positioned proximate said second limit of said range of linear longitudinal movement of said member having said threaded hole and with said member having said threaded hole being out of contact with said first edge and with said member having said threaded hole positioned such that the first closure member can be freely opened relative to the second closure member, rotation of said screw in said first direction relative to said housing rotationally moves said member having said threaded hole until said member having said threaded hole contacts said first edge and said member having said threaded hole is positioned such that it is superimposed over a portion of the second closure member, and wherein continued rotation of said screw in said first direction relative to said housing moves said member having said threaded hole along said longitudinal axis of said screw toward said first limit of said range of linear longitudinal movement of said member having said threaded hole to thereby secure the first closure member in a closed position relative to the second closure member and generate a compressive force between the first closure member and the second closure member.

11. The screw drive mechanism of claim 10, wherein with said member having said threaded hole positioned proximate said second limit of said range of linear longitudinal movement of said member having said threaded hole and with said member having said threaded hole positioned such that it is superimposed over a portion of the second closure member, rotation of said screw in said second direction rotationally moves said member having said threaded hole until said member having said threaded hole is positioned such that the first closure member can be freely opened relative to the second closure member.

12. The screw drive mechanism of claim 11, wherein said housing further defines a second edge, wherein with said member having said threaded hole positioned proximate said first limit of said range of linear longitudinal movement of said member having said threaded hole and with said member having said threaded hole being in contact with said second edge, rotation of said screw in said second direction relative to said housing moves said member having said threaded hole along said longitudinal axis of said screw toward said second limit of said range of linear longitudinal movement of said member having said threaded hole.

13. The screw drive mechanism of claim 10, wherein said housing further defines a second edge, wherein with said member having said threaded hole positioned proximate said first limit of said range of linear longitudinal movement of said member having said threaded hole and with said member having said threaded hole being in contact with said second edge, rotation of said screw in said second direction relative to said housing moves said member having said threaded hole along said longitudinal axis of said screw toward said second limit of said range of linear longitudinal movement of said member having said threaded hole.

14. The screw drive mechanism of claim 10, wherein said housing is adapted for mounting to a first closure member that cooperates with a second closure member, the second closure member is movable relative to the first closure member, wherein said member having said threaded hole is a pawl, and wherein with said member having said threaded hole positioned proximate said second limit of said range of linear longitudinal movement of said member having said threaded hole and with said member having said threaded hole positioned such that said member having said threaded hole cannot interfere with the second closure member, rotation of said screw in said first direction relative to said housing rotationally moves said member having said threaded hole until said member having said threaded hole is positioned such that it can interfere with the second closure member if movement of the second closure member relative to the first closure member is attempted, and wherein continued rotation of said screw in said first direction relative to said housing moves said member having said threaded hole along said longitudinal axis of said screw toward said first limit of said range of linear longitudinal movement of said member having said threaded hole to thereby secure the second closure member in a closed position relative to the first closure member and generate a compressive force between the second closure member and the first closure member.

15. The screw drive mechanism of claim 14, wherein with said member having said threaded hole positioned proximate said second limit of said range of linear longitudinal movement of said member having said threaded hole and with said member having said threaded hole positioned such that it can interfere with the second closure member if movement of the second closure member relative to the first closure member is attempted, rotation of said screw in said second direction rotationally moves said member having said threaded hole until said member having said threaded hole is positioned such that said member having said threaded hole can no longer interfere with the second closure member and the second closure member can be freely opened relative to the first closure member.

16. The screw drive mechanism of claim 10, wherein said motor drive comprises a motor and a gearbox.

* * * * *